US005778722A

United States Patent [19]

Saiki et al.

[11] Patent Number: 5,778,722

[45] Date of Patent: Jul. 14, 1998

[54] METHOD OF PRODUCING SEAMLESS CANS

[75] Inventors: Norihito Saiki, Kawasaki; Katsuhiro Imazu, Yokohama; Akira Kobayashi, Chigasaki; Tomomi Kobayashi, Yokohama, all of Japan

[73] Assignee: Toyo Seikan Kaisha, Ltd., Tokyo, Japan

[21] Appl. No.: 871,769

[22] Filed: Jun. 9, 1997

Related U.S. Application Data

[63] Continuation of Ser. No. 388,487, Feb. 14, 1995, abandoned.

[30] Foreign Application Priority Data

Feb. 15, 1994 [JP] Japan ..... 6-039358

[51] Int. Cl.[6] ..... B21D 51/26

[52] U.S. Cl. ..... 72/347; 72/379.4

[58] Field of Search ..... 72/347, 349, 379.4

[56] References Cited

U.S. PATENT DOCUMENTS

| | | | |
|---|---|---|---|
| 4,346,580 | 8/1982 | Saunders . | |
| 4,425,778 | 1/1984 | Franek et al. | 72/349 |
| 4,522,049 | 6/1985 | Clowes | 72/349 |
| 4,711,611 | 12/1987 | Bachmann et al. . | |
| 5,168,742 | 12/1992 | Heyes et al. | 72/467 |

FOREIGN PATENT DOCUMENTS

| | | |
|---|---|---|
| 2092985 | 8/1982 | United Kingdom . |
| 2240503 | 8/1991 | United Kingdom . |
| 8101259 | 5/1981 | WIPO . |

*Primary Examiner*—Lowell A. Larson

*Attorney, Agent, or Firm*—Sughrue, Mion, Zinn, Macpeak & Seas, PLLC

[57] ABSTRACT

A method of producing seamless cans wherein a blank holder 2 is inserted in a metal cup 5 coated with an organic film 12, a punch 1 is advanced into a cavity 7 in a die 3 while pushing the bottom 5*a* of the metal cup onto the flat surface portion 3*a* of the die by the blank holder 2, so that the side wall 5*b* of the metal cup 5 is brought into intimate contact with the flat surface portion 3*a* of the die and with the working corner 3*b* having a small radius of curvature, thereby to reduce the thickness of the side wall 5*b* by bend-elongation. Moreover, the portion to be subjected to the necking is ironed at an ironing ratio of not smaller than 5% by the punch 1 in cooperation with the front end $3b_1$, of the working corner 3*b*, or by the front end $3b_1$, and an ironing portion of a short cylindrical portion in front thereof, or by the punch 1 in cooperation with the ironing portion 3*g* of the die 3 by advancing the side wall 5*b* slightly toward the inside in the cavity 7, thereby to obtain a seamless can 20 having a reduced thickness in the side wall 5*b*. This method makes it possible to control the thickness distribution in the side wall and, hence, to produce seamless cans having reduced thickness in the side wall permitting the organic film to be least whitened during the necking working.

6 Claims, 19 Drawing Sheets

METHOD OF PRODUCING SEAMLESS CANS

This is a Continuation of application No. 08/388,487 filed Feb. 14, 1995, now abandoned.

BACKGROUND OF THE INVENTION 1. (Field of the Invention)

The present invention relates to a method of producing seamless cans for forming container bodies that are used for containing carbonated beverages, beer, coffee, fruit juices, etc.

2. (Description of the Prior Art)

A method has been proposed for producing relatively elongated seamless cans of which the thickness of the side wall is reduced by redraw-forming a draw-formed metal cup coated with an organic film using a die having a small radius of curvature at the working corner (Japanese Laid-Open Patent Publications Nos. 258822/1989 and 155419/1991). According to this method, the thickness is reduced by bend-elongation accompanied, however, by problems as described below.

(1) Breaking limit: When it is attempted to increase the height of the can by greatly reducing the thickness, either a soft metal blank must be used or the number of times of redraw-forming must increased. In the former case, the seamless can loses buckling resistance and pressure resistance at the bottom portion since the side wall portion and the bottom portion are softened. In the latter case, the facility cost and the operation cost increase due to an increase in the number of steps.

(2) Thickness of the side wall portion is not controlled: From the standpoint of decreasing the cost of the material and maintaining strength at a flange portion, it is desired to so control the thickness of the side wall portion that the main portion of the side wall has usually a uniform and reduced thickness and the vicinity of the opening portion has a uniform and relatively large thickness (see a curve of Test No. 1 in FIG. 17). According to the conventional method, however, the distribution of thickness of the side wall portion in the direction of height is dominated by the distribution of thickness of the side wall portion draw-formed in the direction of height in a preceding step and the like factors, and cannot be controlled allowing the thickness to become very nonuniform (see a curve of Test No. 10 in FIG. 17). Due to anisotropy in the material, furthermore, the thickness undergoes variation in the circumferential direction to a relatively large degree.

(3) Deterioration of the organic film: The degree of monoaxial drawing is so large that the necking or the flanging executed at a subsequent step results in the occurrence of whitening or the like phenomenon in the organic film.

SUMMARY OF THE INVENTION

An object of the present invention is to provide a method of producing relatively elongated seamless cans having a side wall portion of a reduced thickness from the metal cups of which the inner and outer surfaces are coated with an organic film, maintaining such advantages that a breaking limit is enhanced in reducing the thickness of the side wall portion, that the distribution of thickness of the side wall portion is controlled, and that the obtained seamless cans little permit the organic film to be deteriorated as represented by whitening when they are subjected to the subsequent working such as necking or the like.

According to the present invention, there is provided a method of producing seamless cans from metal cups made of a metal sheet of which the inner and outer surfaces are coated with an organic film, comprising:

using an annular die which has a horizontal surface, an annular working surface continuous to the horizontal surface, a working corner portion of a small radius of curvature at a boundary portion between the above two surfaces, and an ironing portion that protrudes most toward the inner side and is formed in said annular working surface;

disposing said metal cup on said annular die; and inserting an annular blank holder in the metal cup, advancing a punch from the blank holder into the annular die while pushing the bottom portion of the metal cup by said blank holder onto the horizontal surface of the annular die, so as to pass the wall portion of the metal cup that is to be worked through space between the horizontal surface of the annular die and the blank holder and further through space between the punch and the annular die, whereby the thickness of the wall portion is reduced by bend-elongation at the working corner and is further reduced by the ironing at the ironing portion, the portion subjected to the necking being ironed by at least 5%.

According to this method, the bend-elongation (redraw working) by the working corner of the die and the ironing working are carried out through the same stroke using the same tool.

According to the present invention, there is further provided a method of producing seamless cans from metal cups made of a metal sheet of which the inner and outer surfaces are coated with an organic film, comprising:

using an annular die which has a horizontal surface, an annular working surface continuous to the horizontal surface and a working corner portion of a small radius of curvature at a boundary portion between the above two surfaces;

disposing said metal cup on said annular die;

inserting an annular blank holder in the metal cup, advancing a first punch from the blank holder into the annular die while pushing the bottom portion of the metal cup by said blank holder onto the horizontal surface of the annular die, so as to pass the wall portion that is to be worked through space between the horizontal surface of the annular die and the blank holder and further through space between the first punch and the annular surface of the annular die, whereby the thickness of the wall portion is reduced by bend-elongation at the working corner to obtain a draw-formed cup;

using an annular ironing die having an annular working surface and an ironing portion that protrudes most toward the inner side and is formed in the annular working surface; and disposing said draw-formed cup on said annular ironing die, and advancing a second punch from said draw-formed cup into the annular ironing die in order to further reduce the thickness of the wall portion by ironing at the ironing portion of the annular die, the portion subjected to the necking being ironed by at least 5%.

According to this method, the redraw working and the ironing working are executed in two strokes using separate tools.

The ironing portion formed in the annular working surface of the annular die is a portion which is protruding most toward the inner side. This portion minimizes the clearance with respect to the punch that passes through the annular die, and executes the ironing in cooperation with the punch. Therefore, the ironing ratio is expressed by the following relation, $$\text{Ironing ratio (\%)} = \frac{t_2 - t_3}{t_2} \times 100$$

where $t_2$ is a thickness of the wall portion of the material to be worked that is bend-elongated by the working corner, and $t_3$ is a clearance between the ironing portion and the punch.

According to the present invention, the portion to be necked of the seamless can is ironed at an ironing ratio of at least 5% and, preferably, from 10 to 40%.

DETAILED DESCRIPTION OF THE INVENTION

Figure 1:
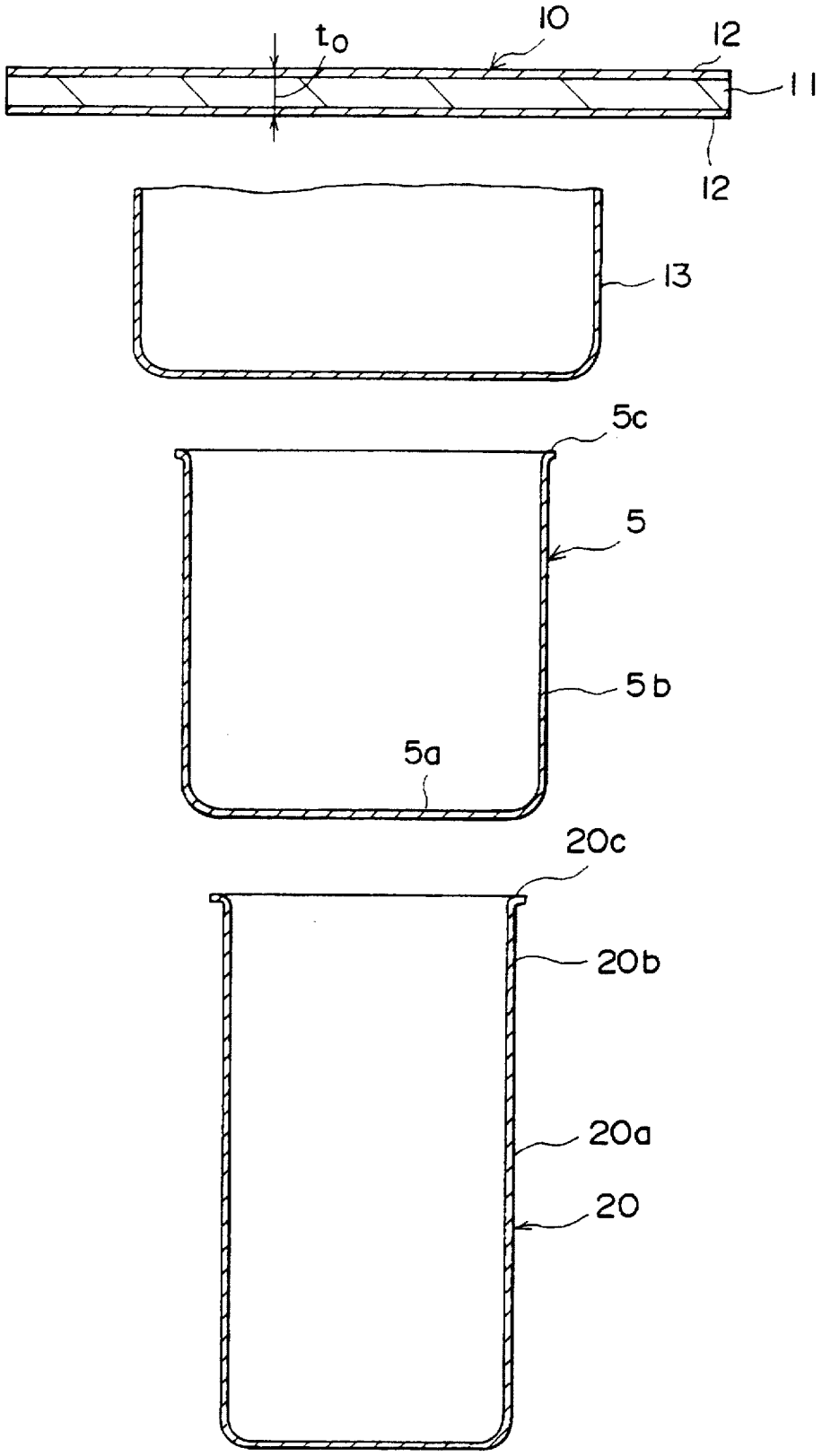
FIG. 1 is a diagram illustrating the steps for producing a seamless can of the present invention from a blank.

According to the present invention, the wall portion of the metal cup that is to be worked is reduced for its thickness by bend-elongation at the working corner, and is then ironed to further reduce the thickness. In particular, the portion subjected to the necking in a subsequent step is ironed at an ironing ratio of at least 5%.

During the bend-elongation, the force is exerted on the wall of the material to be worked in the lengthwise direction of the wall (corresponds to the height of the side wall of the seamless can that is formed). During the ironing, on the other hand, the force is exerted on the wall of the material to be worked in the direction of thickness of the wall. In general, the ironing working contributes to enhancing the breaking limit. According to the present invention which effects the ironing after the bend-elongation in which the force is exerted in a different direction, the two forces act synergistically making it possible to greatly reduce the thickness. According to the present invention, therefore, it is allowed to produce a relatively elongated seamless can having a height/diameter ratio of larger than 1.

During the ironing working, furthermore, the wall portion of the material to be worked is ironed as it passes through a gap between the punch and the ironing portion, and is reduced for its thickness to become substantially equal to the width of the gap. By controlling the gap width in the direction of height during the ironing working, therefore, the thickness of the side wall of the obtained seamless can is controlled in the direction of thickness (see a curve of Test No. 1 in FIG. 17). By setting the gap width to be constant in the circumferential direction, furthermore, the thickness of the side wall portion can be uniformalized in the circumferential direction.

The organic film is reduced for its thickness as it is monoaxially drawn in the direction of height by the redraw working. During the ironing working, however, the organic film is reduced for its thickness while receiving the surface pressure in the direction of thickness thereof. Unlike the case of when the redraw working only is effected, therefore, the thickness distribution is uniformalized on the side wall portion of the obtained seamless can. Therefore, local unevenness or distortion is suppressed at the time of necking or flanging, and the organic film is not deteriorated which is represented by, for example, whitening. Besides, the organic film is smoothed by the ironing working enhancing printability.

According to the present invention, furthermore, it is desired that the surface temperature Td of the annular die that comes in contact with the wall portion of the material to be worked during the forming operation, surface temperature Ts of the blank holder portion opposed to the horizontal surface of the annular die, and surface temperature Tp of the punch just after it is removed from the seamless can that is formed through the forming operation, are set to lie within a range of not higher than a glass transition temperature of the organic film Tg+50° C. but is not lower than 10° C. Within the above-mentioned temperature range, the sliding frictional resistance is relatively small between the tools and the organic film, whereby the organic film is effectively prevented from being broken by the frictional resistance, and the punch after the forming operation can be easily pulled out from the seamless can. For instance, when the surface temperatures of the tools are higher than the above-mentioned range, the organic film is softened during the forming. In particular, the organic film on the outer surface is scraped off during the ironing working or the organic film on the inner surface adheres to the punch and is broken when the punch is removed from the seamless can. When the surface temperatures are lower than the above-mentioned range, on the other hand, sliding frictional resistance so increases that the wall portion tends to be broken or the punch is removed with difficulty.

The surface temperatures of the tools can be controlled by heating the tools in advance prior to carrying out the forming operation, by changing the heating over to the cooling just before starting the forming operation and by continuing the cooling even during the forming operation. That is, a very large force is exerted on the portions where the material to be worked come into contact with the tools during the forming operation, the tools are heated by the heat of friction or by the heat of working the material, and the temperatures of the tools gradually increase as the forming operation is repeated. With the tools being cooled during the forming operation as described above, however, it is allowed to prevent the temperature from rising and to control the temperatures of the tools to lie within a suitable temperature range.

The present invention will now be described by way of embodiments in conjunction with the accompanying drawings.

Referring to FIG. 1 which schematically illustrates a step for producing a seamless can from a metal sheet coated with an organic film, the coated metal sheet 10 is subjected to the draw working which has been known per se, to form a pre-draw-formed cup 13 which is then subjected to the known thickness-reducing redraw working which is disclosed, for example, in Japanese Laid-Open Patent Publication No. 258822/1989 to obtain a redraw-formed cup 5. The redraw-formed cup 5 has a bottom wall 5*a* and a side wall 5*b*, and further has a flange portion 5*c* formed at an upper end of the side wall 5*b*.

According to the present invention, usually, a seamless can 20 is produced by using the pre-draw-formed cup 13 or the redraw-formed cup 5. In the seamless can 20 shown in FIG. 1, a thick portion 20*b* is formed at the upper end (on the side of the opening portion) of a main portion 20*a* of the side wall and a flange 20*c* is formed further at an upper end portion thereof.

Figure 2:
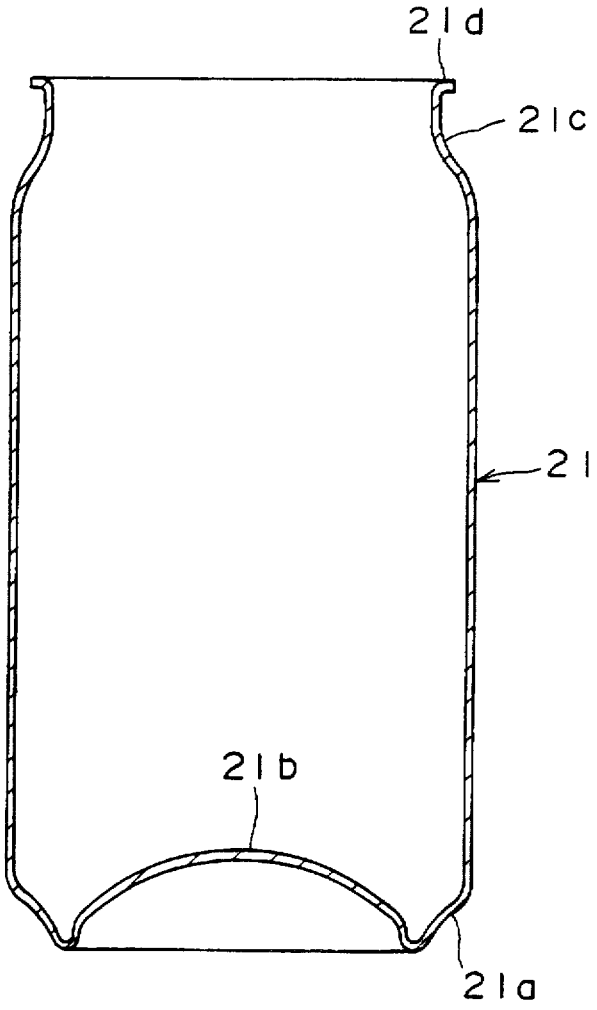
FIG. 2 is a vertical sectional view of a container body produced from the seamless can 20.

The seamless can 20 produced according to the present invention is then subjected to the subsequent working and is formed into a container body 21 as shown in FIG. 2 and is put into practical use being filled with content and fitted with a closure. Through the doming of the seamless can 20, a foot portion 21*a* and a domed portion 21*b* are formed at the bottom of the container body 21. The flange 20*c* is trimmed, and a necked portion 21*c* having a reduced diameter is formed on the lower side of the flange 21*d* at the upper end portion due to the necking and flanging.

(Coated Metal Sheet)

According to the present invention, the coated metal sheet (blank) 10 which is a basic constituent material of the seamless can 20 has an organic film 12 formed on both surfaces of a metal sheet 11 for cans.

Examples of the metal sheet 11 for cans include a tin-free steel plate, a tin-plated steel plate, an electrically zinc-plated steel plate, a nickel-plated steel plate, an aluminum (alloy) thin plate and the like plate having a thickness of from 0.1 to 0.5 mm, which will be used depending upon the applications and sizes of cans.

As the organic film 12, there can be used an undrawn film or biaxialy film of a thermoplastic resin, for example, an olefin resin such as of polyethylene, polypropylene, ethylene-propylene copolymer, ethylene/vinyl acetate copolymer, ethylene/acryl ester copolymer, or ionomer, a polyester such as of polybutylene terephthalate, a polyamide such as nylon 6, nylon 6,6, nylon 11, or nylon 12, or polyvinyl chloride, polyvinylidene chloride, etc. These films can be formed on the metal sheet 11 for cans by heat-melt adhesion, dry lamination, extrusion coating and the like method. The organic film 12 may comprise a single layer of one of these films or a plurality of layers of such films. When the organic film 12 comprises these films, its thickness is usually from 3 to 50 μm. When the film is laminated on the metal sheet 11 for cans, furthermore, there may be used an adhesive agent such as urethane adhesive agent, epoxy adhesive agent, acid-modified olefin resin adhesive agent, copolyamide adhesive agent or copolyester adhesive agent. The thickness of the adhesive agent layer is usually from about 0.1 to 5.0 μm.

In addition to using the above-mentioned films, the organic film 12 can be further formed by coating the metal sheet 11 for cans with at least one of a variety of thermoplastic paints or thermosetting paints followed by drying. Suitable examples of the paint include modified epoxy paints such as phenol epoxy and amino epoxy; vinyl chloride/vinyl acetate copolymer paint; saponified vinyl chloride/vinyl acetate copolymer paint; vinyl chloride/vinyl acetate/maleic anhydride copolymer paint; modified vinyl paints modified with epoxy, epoxyamino or epoxyphenol; acryl paint; synthetic rubber paints such as styrene/butadiene copolymer paint, and the like. The organic film 12 formed of these paints has a thickness of usually from about 2 to about 30 μm (dry thickness of film). (Production of Seamless Cans)

According to the production method of the present invention, the seamless can 20 is produced by using, for example, the aforementioned redraw-formed cup 5 or the pre-draw-formed cup 13. Here, however, it is desired to apply a variety of lubricating agents to the redraw-formed cup 5 or the like cup prior to effecting the forming. Preferred examples of the lubricating agent are those which arouse no problem from the standpoint of food sanitation and can be easily volatilized and removed upon heating at about 200° C. such as liquid paraffin, synthetic paraffin, white vaseline, edible oil, hydrogenated edible oil, palm oil, a variety of natural waxes, polyethylene wax, etc. The amount of application should desirably be from 0.1 to 10 mg/dm$^2$.

Figure 3:
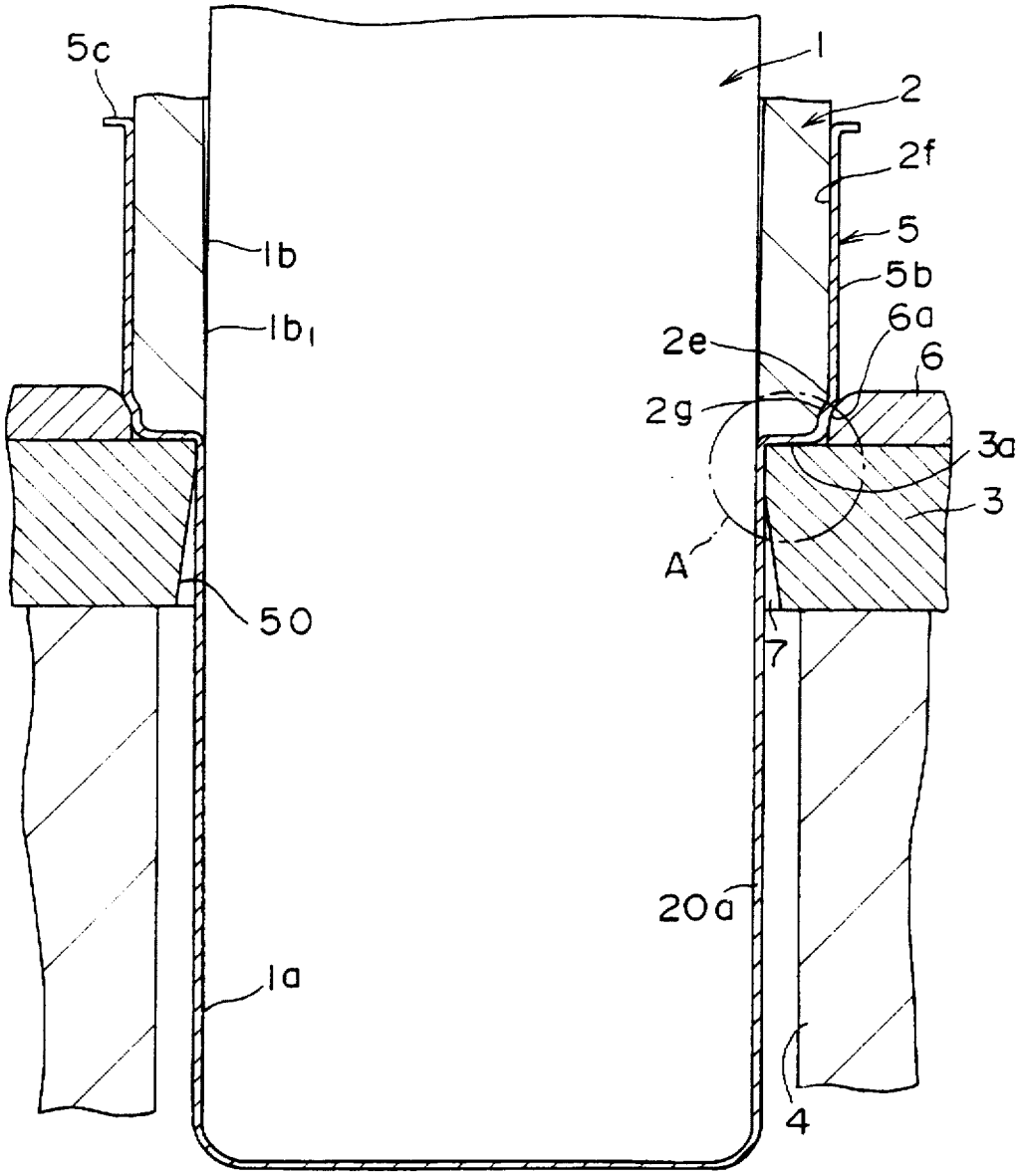
FIG. 3 is a vertical sectional view illustrating a state where the seamless can 20 of FIG. 1 is being formed through one stroke.
Figure 4:
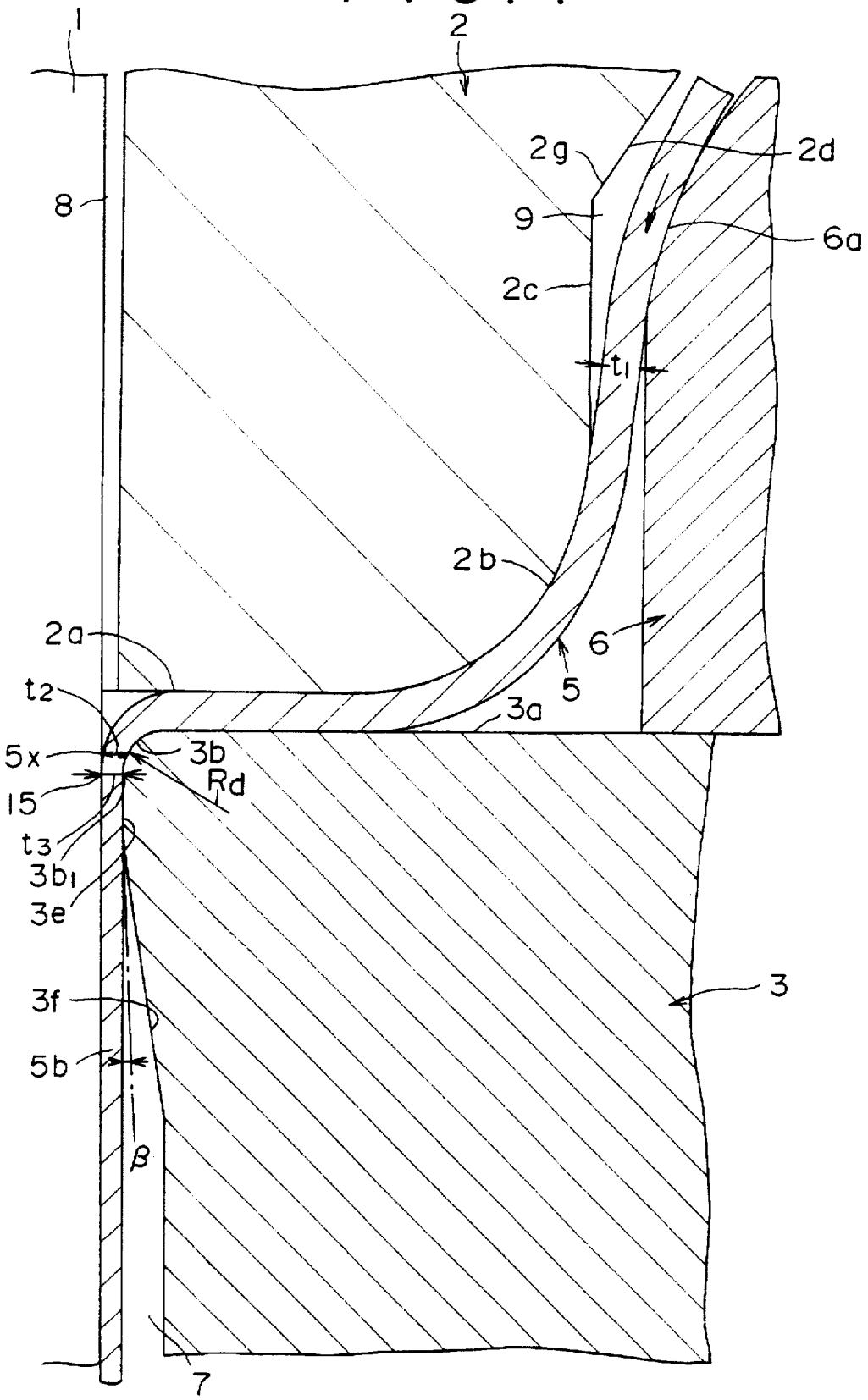
FIG. 4 is a vertical sectional view illustrating a portion A of FIG. 3 on an enlarged scale of when a die of a first embodiment is used.

FIG. 3 illustrates a step for effecting the thickness-reducing bend-elongation and the ironing working through one stroke according to the present invention. FIG. 4 illustrates a major portion thereof on an enlarged scale, and FIG. 5 illustrates a state of when the forming is finished.

Figure 5:
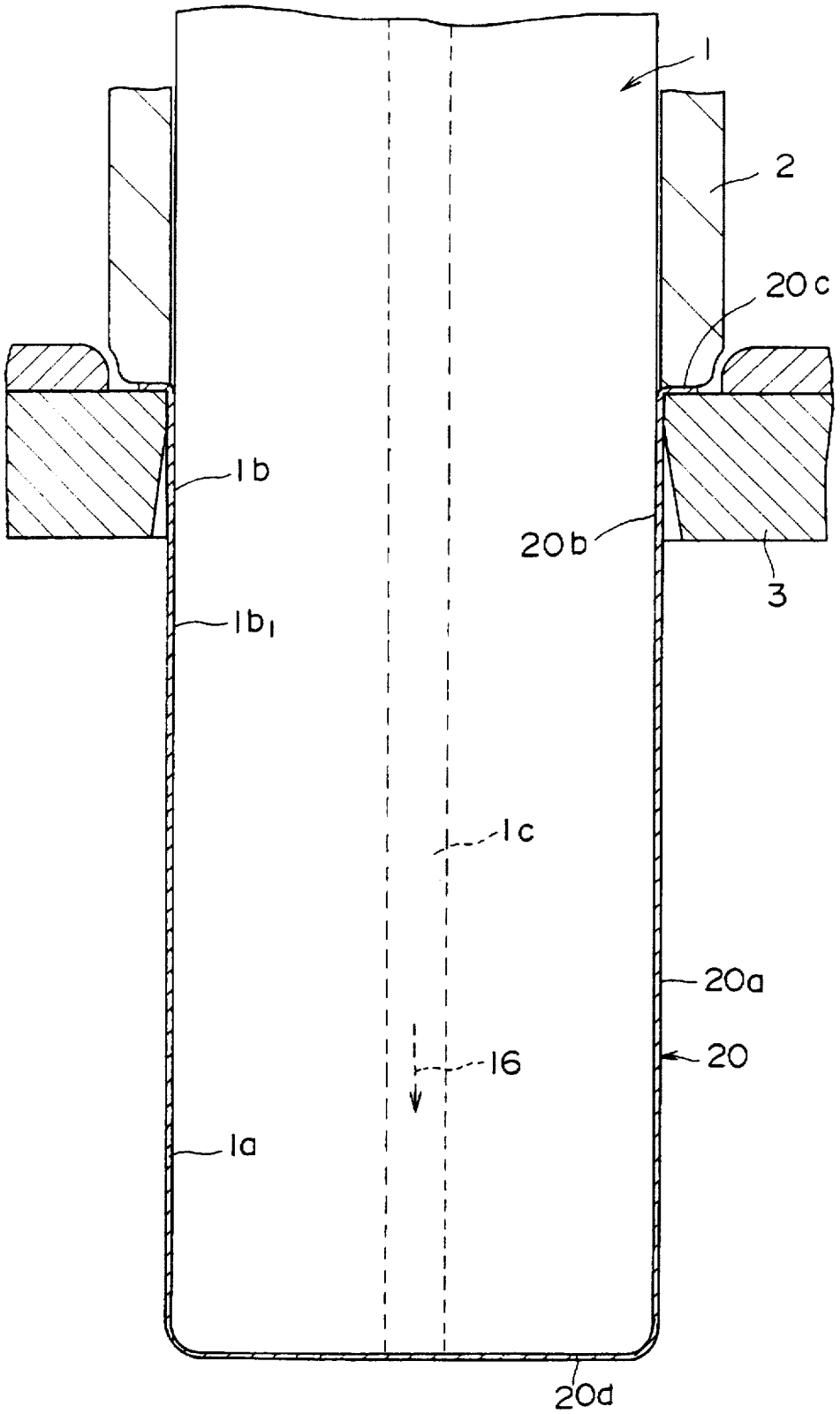
FIG. 5 is a vertical sectional view illustrating a state just after the forming of the seamless can 20 is finished.

In FIGS. 3 to 5, use is made of a punch 1, a blank holder 2 and an annular die 3 as principal tools for forming.

The punch 1 is held by a punch plate (not shown), and the blank holder 2 is provided in the upper die shoe (not shown) in concentric with the punch 1 to surround the punch 1 maintaining a small gap 8 (see FIG. 4). The punch 1 and the blank holder 2 are so provided as to move up and down at a predetermined timing relying upon a mechanism such as crank mechanism (not shown) or the like. The annular die 3 is disposed in concentric with the punch 1, and is provided in the lower die shoe (not shown) via a die holder 4.

On the flat surface portion 3*a* of the annular die 3 is secured an annular bending member 6 in concentric with the punch 1. In forming redraw-formed the cup 5 by driving the punch 1, the annular bending portion 6 forms a diameter-contracted portion at a lower portion of the side wall 5*b* of the cup 5 relying upon the continuous bend working, so that the side wall 5*b* can be smoothly introduced into the forming region and that the bend-elongation is effectively carried out.

In such a state, the punch 1 comprises a front portion 1*a* and a small-diameter portion 1*b* that is continuous to the front portion 1*a* via a tapered portion 1*b*1. That is, the front portion 1*a* is to form a main portion 20*a* of the seamless can 20 shown in FIG. 1, and the small-diameter portion 1*b* is to form a thick portion 20*b* of the seamless can 20.

The blank holder 2 has a cylindrical outer peripheral surface 2*f* having an outer diameter which nearly corresponds to the inner diameter of the redraw-formed cup 5, and has a flat holding surface 2*a* formed at the lower portion thereof. As best shown in FIG. 4, to the end portion on the outer side of the holding surface 2*a* are continuing a curved portion 2*b*, a short cylindrical portion 2*c* and a titled portion 2*d* that upwardly extends toward the outer side in a tilted manner in the order mentioned. The tilted portion 2*d* is continuous to the outer peripheral surface 2*f* via a curved portion 2*e* (FIG. 3). The short cylindrical portion 2*c* and the tilted portion 2*d* together are forming a recessed portion 2*g* having a step. As will be obvious from such a shape of the blank holder, the lower portion of the blank holder 2 has a diameter smaller than that of the outer peripheral surface 2*f* such that the blank holder 2 can be inserted in the redraw-formed cup 5 to be formed.

The annular bending member 6 is so disposed as to surround the blank holder 2 that is introduced into the redraw-formed cup 5, a portion 6*a* corresponding to the recessed portion 2*g* is curved, and a gap 9 between the curved portion 6*a* and the recessed portion 2*g* is set to be slightly larger than the thickness ($t_i$) of the side wall 5*b* of the cup 5 to be formed.

The annular die 3 has the flat and horizontal surface portion 3*a* and an annular working surface 50 (FIG. 3). These surfaces are continuous via a working corner 3*b* having a small radius of curvature Rd, and the annular working surface 50 is forming a cavity 7 which permits the punch 1 to be inserted or removed. On the annular working surface 50 is further formed an ironing portion $3b_1$ at a position which is the lower end of the working corner 3*b*. Continuous to the ironing portion 3*b* 1 is an escape surface 3*e* having a taper angle βwith respect to the axial line, and a peripheral surface 3*f* of a conical truncated shape is formed continuous to the escape surface 3*e*. The ironing portion $3b_1$ is to execute the ironing working in cooperation with the punch 1 and inevitably protrudes most in the annular working surface 50.

By using the above-mentioned forming tools, the redraw-formed cup 5 is formed as described below.

First, the cup 5 coated with the lubricating agent is held on the annular die 4 or on the curved portion 6*a* of the annular bending member 6.

In this state, the blank holder 2 is inserted in the cup 5, and the punch 1 is advanced into the cavity 7 of the annular die 3 (FIG. 3). As the blank holder 2 is inserted, the side wall 5*b* of the cup 5 is subjected to the bending repetitively such as inward bending along the curved portion 2*e*, reverse bending along the curved portion 6*a* and inward bending along the curved portion 2*b* in the order mentioned due to the blank holder and the annular bending member 6.

As the punch 1 is introduced into the cavity 7, furthermore, the side wall 5*b* is pulled by the punch 1 and passes through the working corner 3*b* and the ironing portion $3b_l$ while being continuously subjected to the above-mentioned bend working and being pushed by the blank holder 2 onto the flat surface portion 3*a* of the annular die 3 to such a degree that wrinkles do not develop.

While passing through the working corner 3*b*, the side wall 5*b* is subjected to the above-mentioned repetitive bending and to a relatively large reverse tensile force due to the blank-holding force, and is further subjected to large bending and bend-elongation due to tension, and then passes through a gap 15 of a width of $t_3$ defined by the ironing portion $3b_1$, and the punch 1 so as to be subjected to the ironing working. That is, the side wall is subjected to the draw working until the inner surface thereof comes into contact with the punch 1 so that the thickness reduces from $t_1$ to $t_2$ and, after brought into contact with the punch 1 at a contact portion 5*x*, the side wall is subjected to the ironing working so that the thickness further reduces to $t_3$ at the ironing portion $3b_1$. The ironing ratio is expressed by the following relation, $$\text{Ironing ratio (\%)} = \frac{t_2 - t_3}{t_2} \times 100$$

Furthermore, the thickness-reducing drawing ratio by bend-elongation is expressed by the following relation, $$\text{Thickness-reducing drawing ratio} = \frac{t_1 - t_2}{t_1} \times 100$$

The gap $t_3$ between the ironing portion $3b_1$, and the punch 1 corresponds to the thickness of the side wall of the seamless can 20 that is to be formed. For instance, a gap relative to the portion la of the punch defines the thickness of the main portion 20*a*and a gap relative to the portion 1*b* of the punch defines the thickness of the thick portion 20*b*. That is, the punch 1 further advances from the state shown in FIG. 3, the flange portion 20*c* corresponding to the flange portion 5*c* of the cup 5 comes onto the flat surface portion 3*a* of the annular die 3 as shown in FIG. 5 to complete the forming; i.e., the seamless can 20 is formed having the main portion 20*a* of which the thickness is greatly reduced and having the thick portion 20*b* of a relatively large thickness at the upper portion.

According to the present invention, the portion (thick portion 20*b*) of the seamless can subjected to the necking is ironed by at least 5% and, particularly, by from 10 to 40%. When the ironing ratio at this portion is smaller than 5%, the thickness does not become uniform in this portion and the organic film 12 is deteriorated as represented by whitening or the like.

The punch 1 in the state of FIG. 5 is removed as described below. The die 3 is lowered from the bottom portion 20*d* of the seamless can 20 with the blank holder 2 being secured and, at the same time, the punch 1 is raised while blowing the air 16 through the air-guide hole 1c formed in the punch 1. While the punch 1 is being raised, the flange portion 20*c* of the seamless can 20 is held by the blank holder 2 and stays at a position shown, permitting the punch 1 to be removed from the seamless can 20.

According to the present invention described above, the degree of thickness reduction by bend-elongation increases with a decrease in the radius of curvature Rd of the working corner 3*b* of the die 3. Usually, it is desired that the radius of curvature Rd is so set that its ratio relative to the thickness tO of the coated metal sheet 10 (see FIG. 1), i.e., $Rd/t_O$ lies within a range of from 1 to 2.9. When this ratio is smaller than 1, the degree of bend-elongation becomes so large that the side wall is likely to be broken. When this ratio is larger than 2.9, on the other hand, it becomes difficult to reduce the thickness to a sufficient degree.

In the embodiment shown in FIGS. 3 to 5, furthermore, the ironing portion $3b_1$ is formed at the lower end of the working corner 3*b*, and the ironing working is executed immediately after the bend-elongation. The ironing portion $3b_1$ may be a circumferential line forming the end portion of the working corner 3*b* or may have a width in the axial direction from the circumferential line as viewed on the side sectional view of FIG. 4. Usually, this width should not be larger than 5 mm. In such an embodiment, the width of contact is short between the die 3 and the punch 1 during the ironing, and the punch 1 can be easily removed.

The escape surface 3*e* is formed continuously to the ironing portion $3b_1$. With the escape surface 3*e* being formed, the seamless can 20 that has been formed can be easily removed from the die 3. It is desired that the escape angle βof the escape surface 3*e* relative to the axial line of the dies 3 is usually smaller than 5 degrees. When the escape angle βexceeds 5 degrees, the organic film 12 formed on the surface of the seamless can 20 tends to be scraped off when the seamless can 20 is removed. FIG. 4 illustrates the escape angle βpresuming that the outer surface of the wall portion 5*b* after the ironing working is in parallel with the axial line.

It is desired that the surface temperature Td of portions of the die 3 that come into contact with the side wall 5*b*, i.e., the surface temperature Td of the flat surface portion 3*a* and of the working corner 3*b* during the forming, is not higher than a glass transition temperature of the organic film 12 Tg+50° C. but is not lower than 10° C. and, preferably, is not higher than Tg+30° C. but is not lower than 15° C. . When the surface temperature is higher than Tg+50° C. the organic film 12 exhibits an increased coefficient of sliding friction and is softened. Therefore, during the forming and, particularly, during the ironing working, the organic film 12 on the outer surface is scraped off making it difficult to obtain satisfactory products. When the temperature is lower than 10° C. , on the other hand, the barrel tends to be broken probably because of an increased sliding frictional resistance between the die 3 and, particularly, the flat surface portion 3*a* and the organic film 12 on the outer surface. On account of the same reason, it is desired that the surface temperature Ts on the holding surface 2*a* of the bank holder 2 is not higher than the glass transition temperature of the organic film 12 Tg+50° C. but is not lower than 20° C. and, preferably, is not higher than Tg+30° C. but is not lower than 15° C. .

It is desired that the surface temperature Tp of the punch just after it is removed is not higher than the glass transition temperature of the organic film 12 Tg +50° C. but not lower than 10° C. and, preferably, is not higher than Tg +30° C. but is not lower than 15° C. When the surface temperature is higher than Tg+50° C.., the film exhibits an increased coefficient of sliding friction and is softened. When the punch 1 is removed from the seamless can 20, therefore, the organic film 12 on the inner surface is scraped off making it difficult to obtain satisfactory products. When the surface temperature is lower than 10° C.., on the other hand, the punch 1 is removed with difficulty because of an increased coefficient of sliding friction between the surface of the punch 1 and the organic film 12.

Usually, the seamless cans 20 are continuously produced by using a transfer press. In this case, the following method is preferably employed in order that the surface temperatures Td, Ts and Tp of the die 3, blank holder 2 and punch 1 lie within the above-mentioned temperature range.

Through holes (not shown) are formed in the die 3, blank holder 2 and punch 1, the hot water (preferably maintained at about 40 to 85° C..) is permitted to flow through the die 3 prior to starting the forming operation, the hot water is changed over to the cold water (about 5 to 30° C.. , more preferably, about 12 to 18C.) just before starting the forming operation and the cold water is permitted to flow continuously during the forming operation. That is, prior to starting the forming operation, the hot water is supplied to heat the die 3, blank holder 2 and punch 1 so as to have surface temperatures Td, Ts and Tp which are not lower than 10° C. After the forming is started, the surface temperatures Td, Ts and Tp rise due to the heat of working and the heat of friction. In order to suppress the temperature rise and to maintain the surface temperatures Td, Ts and Tp not higher than Tg+50° C. the cold water is permitted to flow through the die 3, blank holder 2 and punch 1.

As described above, the method of effecting the bend-elongation and ironing working through one stroke is very advantageous in economy as it improves breaking limit owing to the mutual action of working forces acting in different directions, simplifies the steps and reduces the cost of tools.

Figure 6:
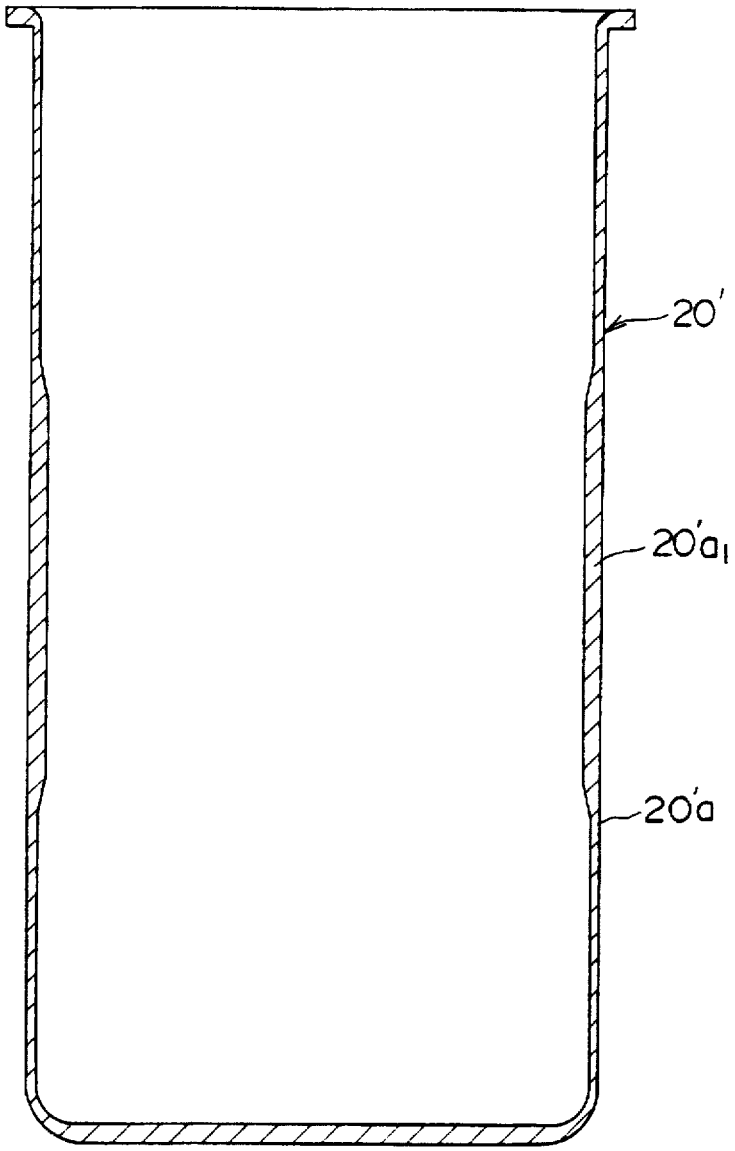
FIG. 6 is a vertical sectional view of another seamless can produced by the method of the present invention.

The production method shown in FIGS. 3 to 5 has dealt with the case of producing seamless cans 20 having a side wall (barrel portion) of which the upper portion is made thick as shown in FIG. 1. This method, however, can also be adapted to producing seamless cans 20' as shown in FIG. 6. In this seamless can 20', the central portion $20'a_1$ of the barrel 20' a is made thick over about one-third of the height. The seamless can 20' can be produced through the operation quite in the same manner as the method shown in FIGS. 3 to 5 except that a portion corresponding to the thick portion $20'a_1$ is rendered to have a small diameter. The seamless can 20' of this type has a relatively large dent strength in the barrel portion 20' a and is adapted to the so-called negative-pressure canning in which the pressure becomes negative. Even in this case, the portion (portion higher than $20'a_1$) subjected to the necking is ironed at an ironing ratio of not smaller than 5% and, particularly, from 10 to 40%. So far as such an ironing working is carried out, the ironing ratio in the thick portion $20'a_1$ may be very smaller than the above-mentioned range.

FIGS. 7 to 11 illustrate other embodiments for effecting the bend-elongation (thickness-reducing redraw working) and the ironing working in one stroke. According to these methods, the radius of curvature at the working corner 3*b* of the die 3, ironing ratio and controlling the temperatures of the working tools are the same as those of the method shown in FIGS. 3 to 5, but the position of the ironing portion $3b_1$ is changed.

Figure 7:
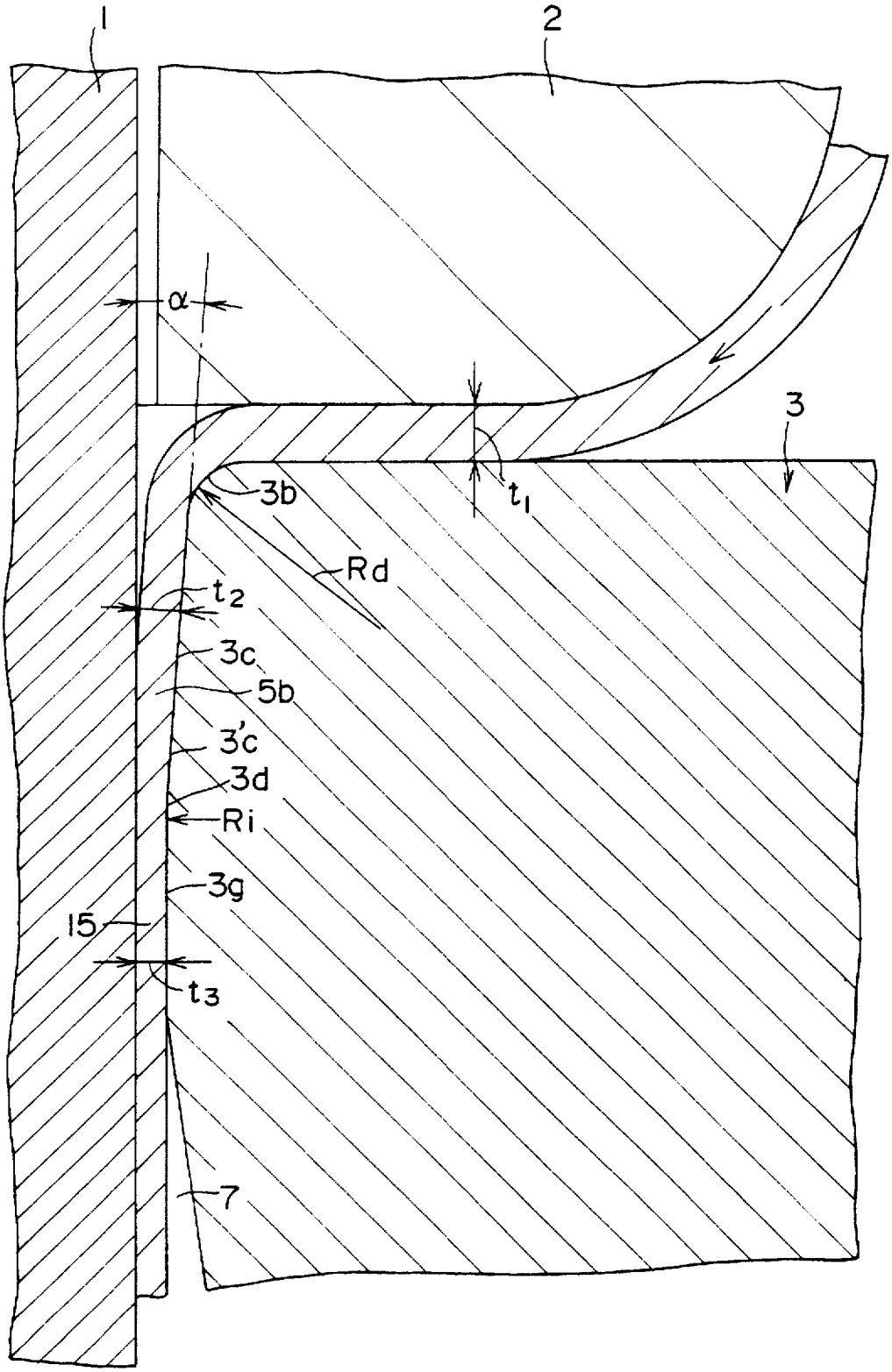
FIG. 7 is a vertical sectional view of the portion A of FIG. 3 on an enlarged scale of when the die according to a second embodiment is used.

In FIG. 7, for instance, the ironing portion 3*g* formed in the annular working surface of the die 3 has a suitable width in the axial direction and is continuous to the working corner 3*b* via the approach surface 3*c*. That is, as the punch 1 advances, the side wall 5b is bend-elongated by the working corner 3b of the die 3 while receiving a relatively large reverse tension and bending force of a large curvature, so that the thickness is reduced from $t_i$ to $t_2$. The side wall 5b then advances in the cavity being slightly tilted inwardly along the approach surface 3c, passes through a gap 15 between the ironing portion 3g and the punch 1 owing to the cooperation of the punch 1, ironing portion 3g and approach surface 3c so as to be ironing worked, whereby the thickness is further reduced from $t_2$ to $t_3$. That is, the side wall 5b comes into contact with the punch 1 before arriving at the ironing portion 3g as shown. With the above-mentioned approach surface 3c being formed, the heat generated by bend-elongation at the working corner 3b escapes into the die 3 via the approach surface 3c giving an advantage that the temperature rise of the material 5b to be worked is suppressed.

In the embodiment of FIG. 7, the wall 5b of the cup 5 that is to be worked is outwardly pulled in a tilted manner along the approach surface 3c and is ironed by the punch 1 at the ironing portion 3g. In this case, it is desired that an approach angle α subtended by the approach surface 3c relative to the axis of the die 3 is within a range of from 1 to 5 degrees, and the junction portion 3d between the ironing portion 3g and the approach surface 3c is a sharp corner portion or a curvature portion having a radius of curvature Ri which is smaller than $0.3\times t_0$ ($t_o$ is the thickness of the blank 10). That is, by setting the approach angle α to be not larger than 5 degrees, the load exerted on the junction portion 3d due to the ironing can be decreased, and the organic film 12 on the outer surface can be effectively prevented from being scraped off during the ironing. When the approach angle α is smaller than 1 degree, on the other hand, the ironing surface pressure (force for outwardly pushing the entire die 3) becomes so large that the annular working surface of the die 3 undergoes an elastic deformation in a manner to outwardly expand in the radial direction. Therefore, the gap increases between the punch 1 and the ironing portion 3g, making it difficult to obtain a predetermined ironing ratio. In removing the punch 1 from the die 3 after the working has been finished, furthermore, the gap (between the punch 1 and the ironing portion 3g) returns to the initial narrow gap due to the elastic recovery of the die 3. Accordingly, the punch 1 is tightened and is removed with difficulty.

In FIG. 7, furthermore, when the junction portion 3d is a curvature portion having a radius of curvature Ri over a range of $(0.3 \text{ to } 20)\times t_0$, the approach angle a can be set to be relatively large such as from 1 to 45 degrees. That is, when Ri is set to be relatively large, stress concentrating at the ironing portion 3g becomes relatively small. By suitably determining the approach angle α within a range of from 1 to 45 degrees, the organic film 12 on the outer surface is not scraped off during the ironing, a desired ironing ratio is obtained and the punch 1 can be easily removed. For instance, when the approach angle α is larger than 45 degrees, the ironing load becomes too great that the wall 5b of the material being worked is broken and the organic film 12 on the outer surface is easily scraped off. Furthermore, when the radius of curvature Ri is larger than $20\times t_0$ despite the approach angle α is smaller than 45 degrees, the ironing portion 3g undergoes elastic deformation due to the ironing surface pressure, and it becomes difficult to obtain a desired ironing ratio and the punch 1 is removed with difficulty because of the same reasons as described above.

Figure 8:
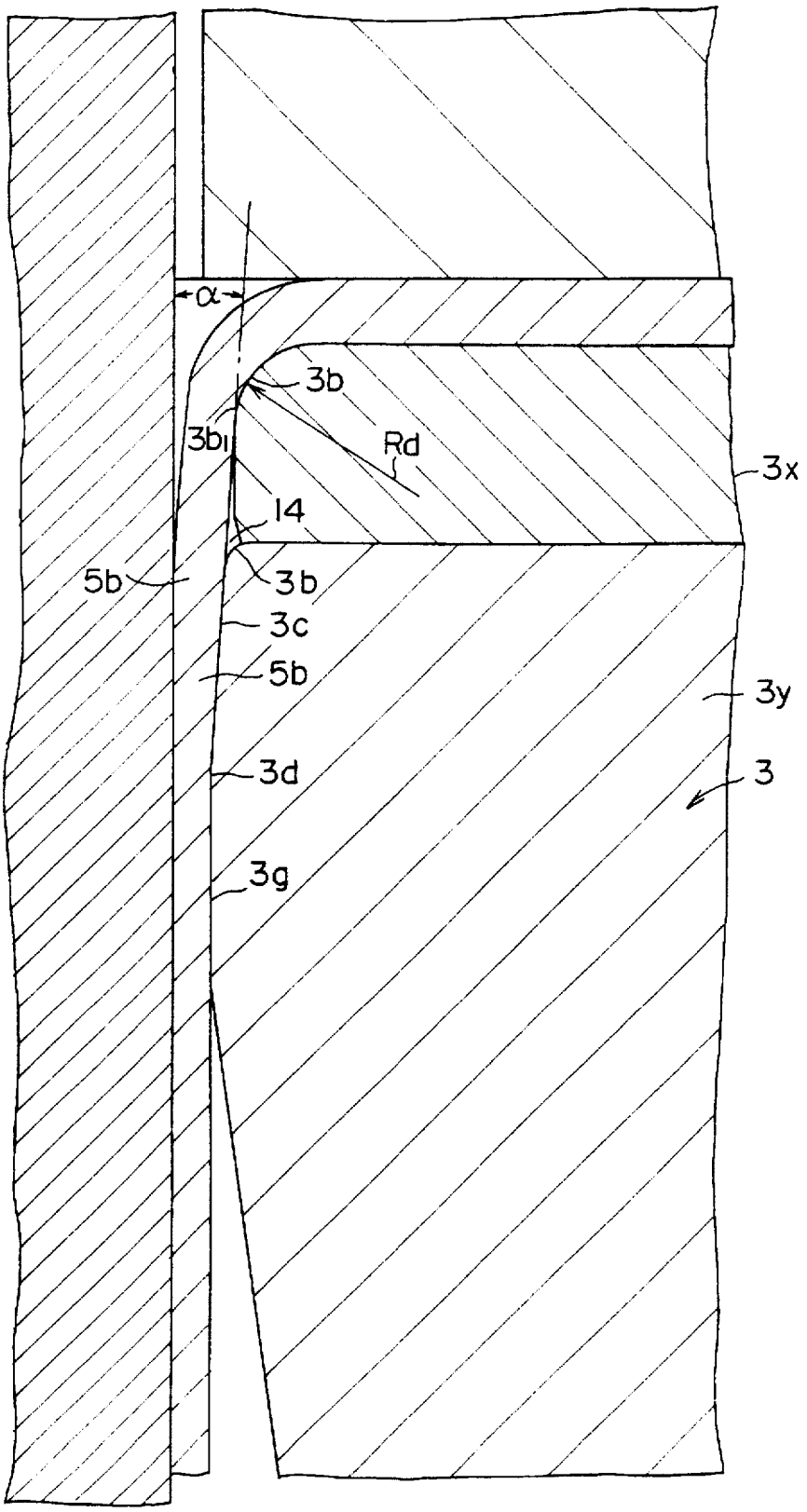
FIG. 8 is a vertical sectional view of the portion A of FIG. 3 on an enlarged scale of when the die according to a third embodiment is used.

In an embodiment shown in FIG. 8, the die 3 is constituted by a die 3x for bend working and a die 3y for ironing working, the two dies being secured to each other. That is, the die is substantially the same as that of the embodiment of FIG. 7 except that the annular working surface below the working corner 3b of the bending die 3x is tilted downwardly and is forming an annular recessed portion 14 in the way to the ironing portion 3g.

In FIG. 8, a portion between the lower end $3b_1$, of the working corner 3b and the junction portion 3d of the ironing die 3y works as the approach surface having the approach angle α, and the wall 5b of the material to be worked is not in contact with the die 3 without, however, arousing any problem. This embodiment is advantageous from the standpoint that the forming tools can be easily manufactured and maintained.

Figure 9:
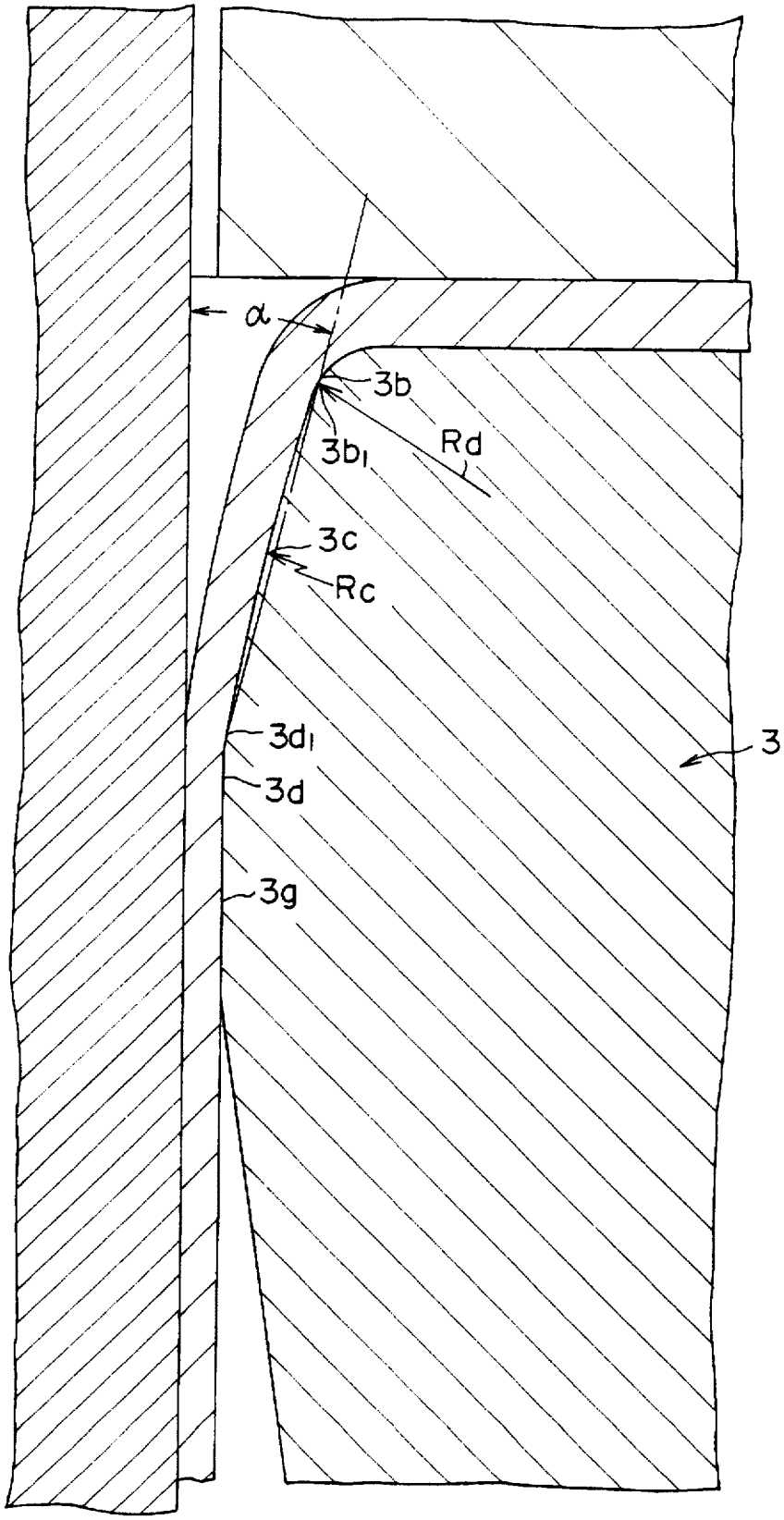
FIG. 9 is a vertical sectional view of the portion A of FIG. 3 on an enlarged scale of when the die according to a fourth embodiment is used.

According to an embodiment shown in FIG. 9, the approach surface 3c of the die 3 shown in FIG. 7 is a surface of curvature having a radius of curvature Rc which slightly protrudes toward the punch 1. The approach angle α in this case is determined based upon a straight line connecting the lower end $3b_1$ of the working corner 3b to the junction portion 3d (upper end $3d_1$ when the junction portion 3d is a curvature portion).

Figure 10:
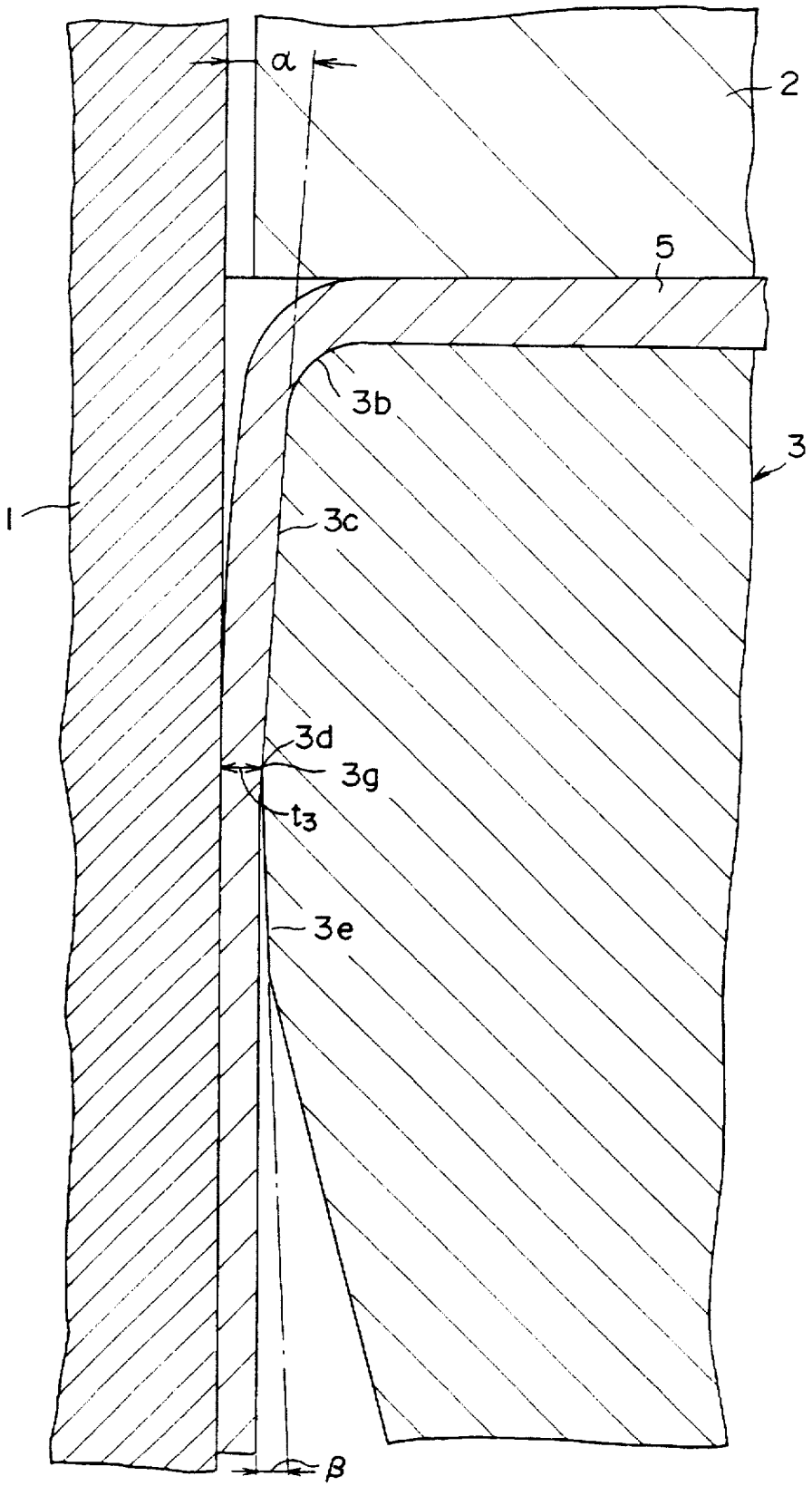
FIG. 10 is a vertical sectional view of the portion A of FIG. 3 on an enlarged scale of when the die according to a fifth embodiment is used.

According to an embodiment shown in FIG. 10, the ironing portion 3g is formed in the junction portion 3d only at the lower end of the approach surface 3c of the die 3 of FIG. 7, and an escape surface 3e having an escape angle β of smaller than 5 degrees is formed in the ironing portion 3g. That is, the ironing portion 3g describes a circumferential line formed by the junction portion 3d. The junction portion 3d (ironing portion 3g) may be a sharp corner or a curvature portion, as a matter of course.

Figure 11:
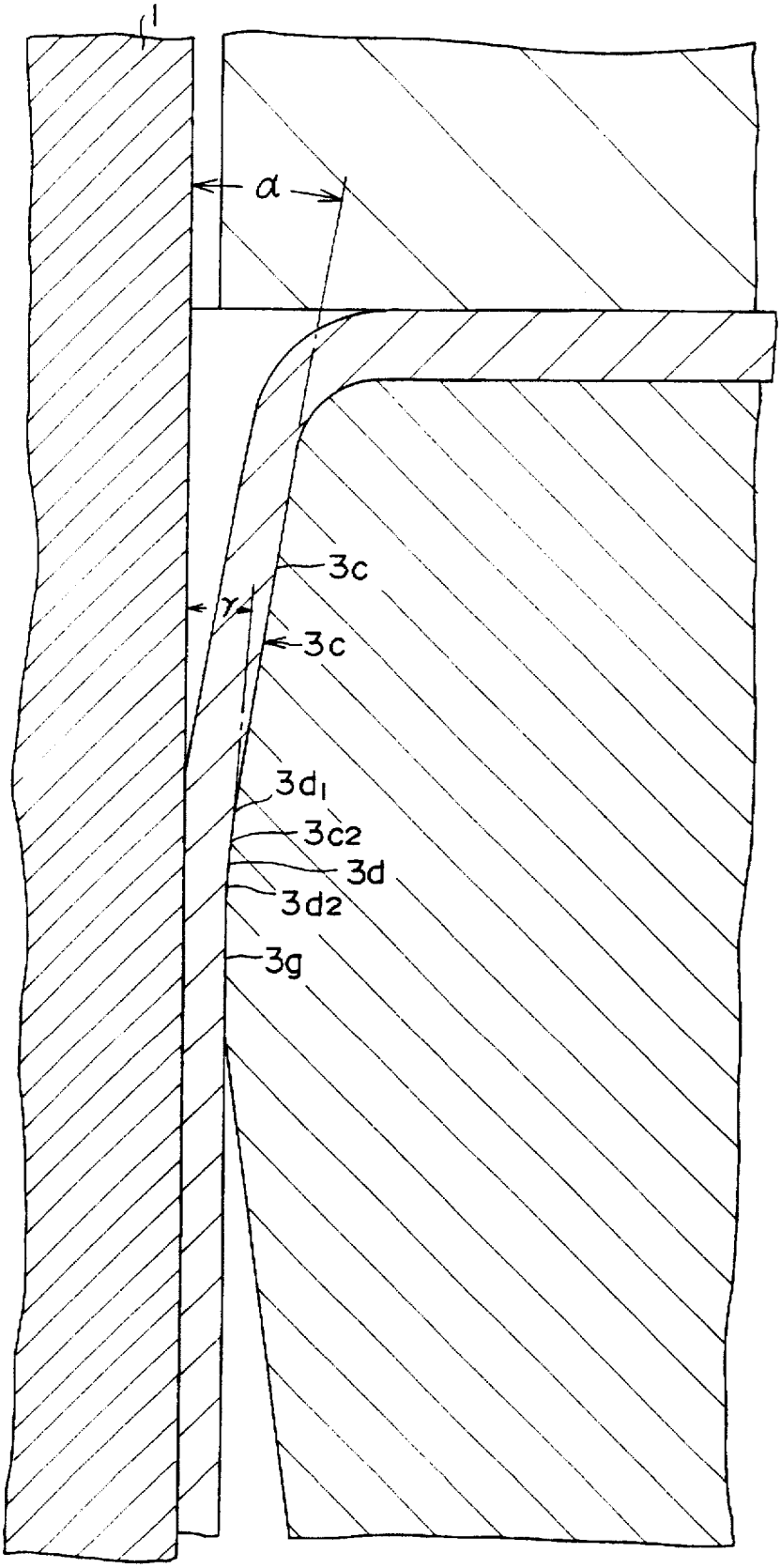
FIG. 11 is a vertical sectional view of the portion A of FIG. 3 on an enlarged scale of when the die according to a sixth embodiment is used.

According to an embodiment shown in FIG. 11, the approach surface 3c of the die 3 in FIG. 7 is constituted by an approach surface (rear approach surface) $3c_1$ on the side of the working corner and an approach surface (front approach surface) $3c_2$ on the side of the ironing portion. In this case, it is desired that the approach angle α of the rear approach surface $3c_1$ is within a range of from 1 to 15 degrees and the approach angle γ of the front approach surface $3c_2$ is smaller than α and lies within a range of from 1 to 5 degrees. It is further desired that a junction portion $3d_1$ between the two approach surfaces and a junction portion $3d_2$ between the front approach surface $3c_2$ and the ironing portion 3g, are sharp corners or curvature portions having a radius of curvature Ri of not larger than $0.3\times t_o$. In FIG. 11, furthermore, though the ironing portion 3g is formed under the junction portion $3d_2$ maintaining a predetermined width, it is also allowable that the ironing portion 3g is the junction portion 3d itself or the circumferential line as shown in FIG. 10. Moreover, the escape surface may be constituted being continuous to the ironing portion 3g like in the aforementioned various embodiments.

Figure 12:
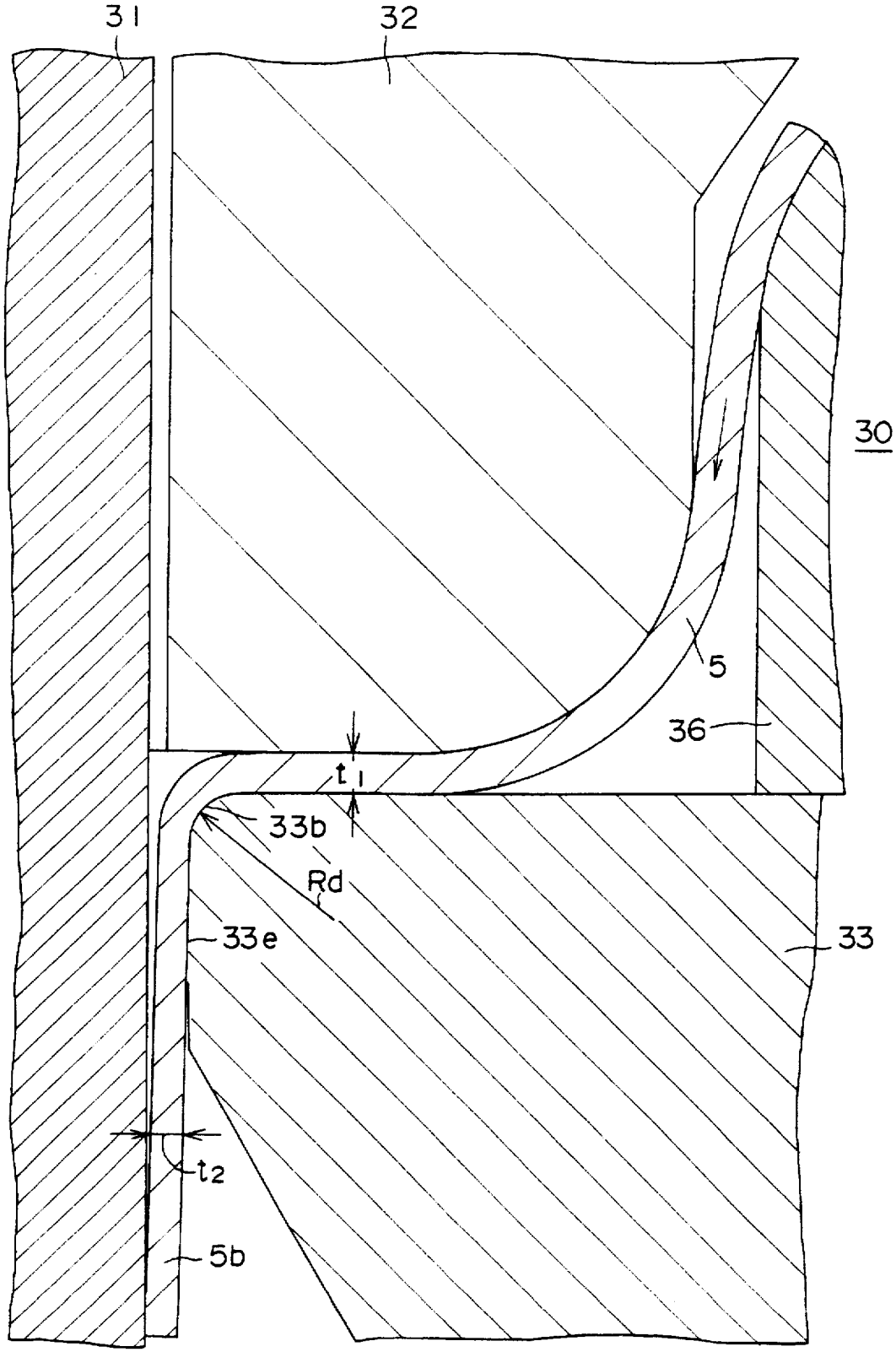
FIG. 12 is a vertical sectional view illustrating a state where the seamless can 20 of FIG. 1 is being draw-formed according to the method of forming the seamless can in two strokes.
Figure 13:
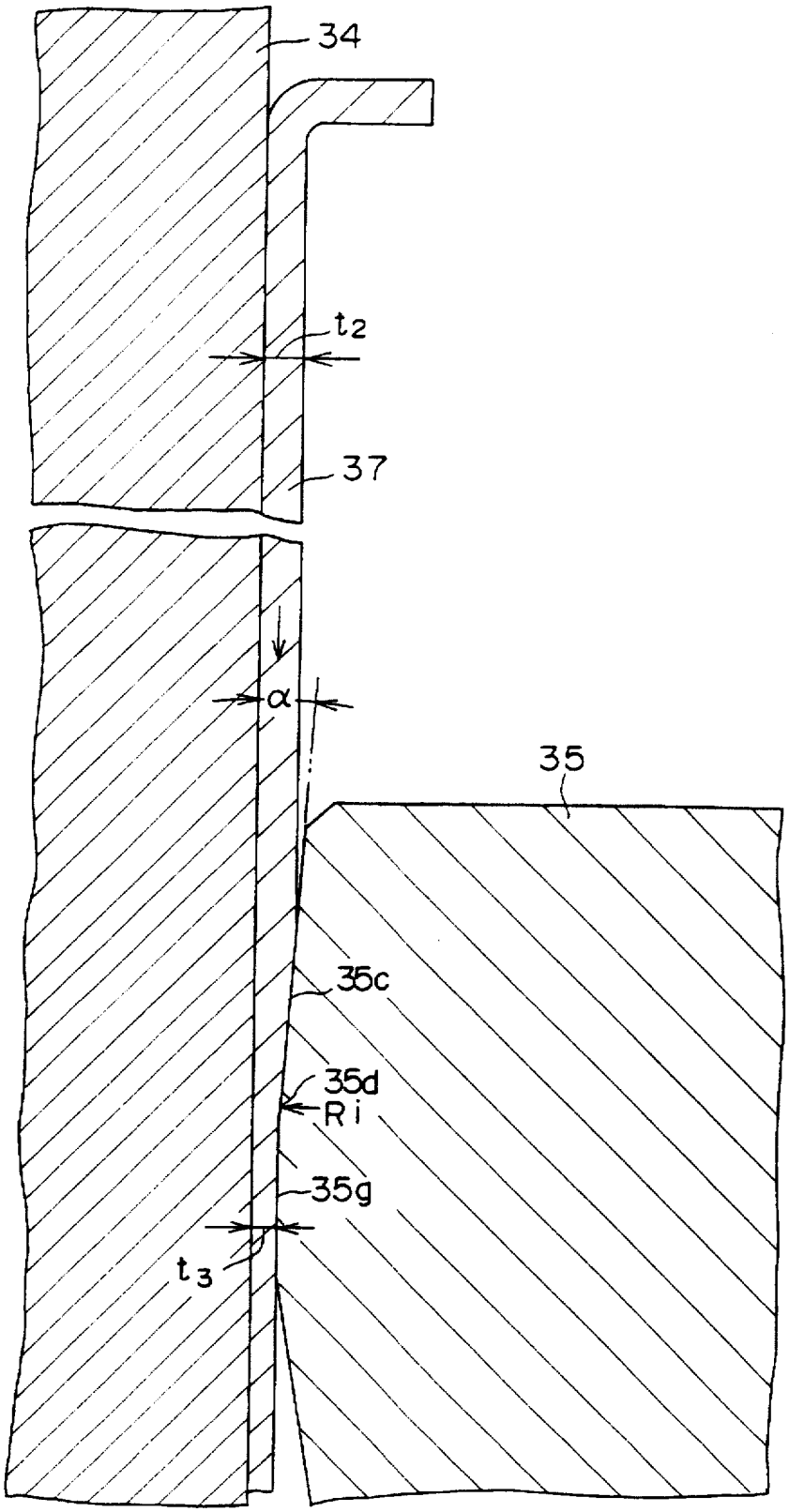
FIG. 13 is a vertical sectional view illustrating a state where the seamless can 20 of FIG. 1 is being ironing-worked according to the method of forming the seamless can in two strokes.

Next, FIGS. 12 and 13 illustrate an embodiment in which the bend-elongation and the ironing working are carried out in separate steps, i.e., in two strokes.

Referring to FIG. 12, a thickness-reduced redraw-formed cup 37 (FIG. 13) having a thickness of the side wall that is reduced from t1 to t2 is formed by using a redrawing tool 30 that is equipped with a punch 31, a blank holder 32, a redrawing die 33 having a working corner 33b and an escape surface 33e with a small radius of curvature Rd, and an annular bending member 36 of nearly the same structure as that of the apparatus shown in FIGS. 3 and 7 but having neither the approach surface 3c nor the ironing portion 3g, under the same redrawing conditions (same die surface temperature Td, etc.), and by advancing the punch 31 to redraw-form the draw-formed metal cup 5.

Then, as shown in FIG. 13, a seamless can 20 is produced by ironing the thickness-reduced redraw-formed cup 37 by using a punch 34 and an ironing die 35 having an approach surface 35*c* with an approach angle α, a junction portion 35*d* with a radius of curvature Ri and an ironing portion 35*g* under the same ironing conditions (die surface temperature, etc.) as those of the case of one-stroke forming method. Even in this ironing working, the portion to be subjected to the necking is ironed at an ironing ratio of at least 5% and, particularly, from 10 to 40%. The ironing portion may be the one of the type shown in FIGS. 10 and 11.

In this case, it is desired that the approach angle α of the approach surface 35*c* is from 1 to 30 degrees, and the junction portion 35*d* between the approach surface 35*c* and the ironing portion 35*g* has a radius of curvature Ri that lies within a range of (0.3 to 20)×$t_0$. Here, the upper limit of the approach angle α is different from that of the case of the one-stroke forming method because of the reason that in the case of the two-stroke forming method, the force of the axial direction produced at the working corner of the die 35 does not act upon the ironing portion 35*g*.

The above-mentioned two-stroke forming method is advantageous in regard to that the machining tools can be easily manufactured and maintained while suppressing the heat generated in the material due to the working.

Both the above-mentioned one-stroke forming method and two-stroke forming method have dealt with the cases of using a stepped punch. As far as the ironing ratio lies within the above-mentioned range in the portion that is to be subjected to the necking, however, it is allowable to execute the forming by using a straight punch without stepped portion. In this case, the inner surface of the side wall of the seamless can becomes straight.

Figure 16:
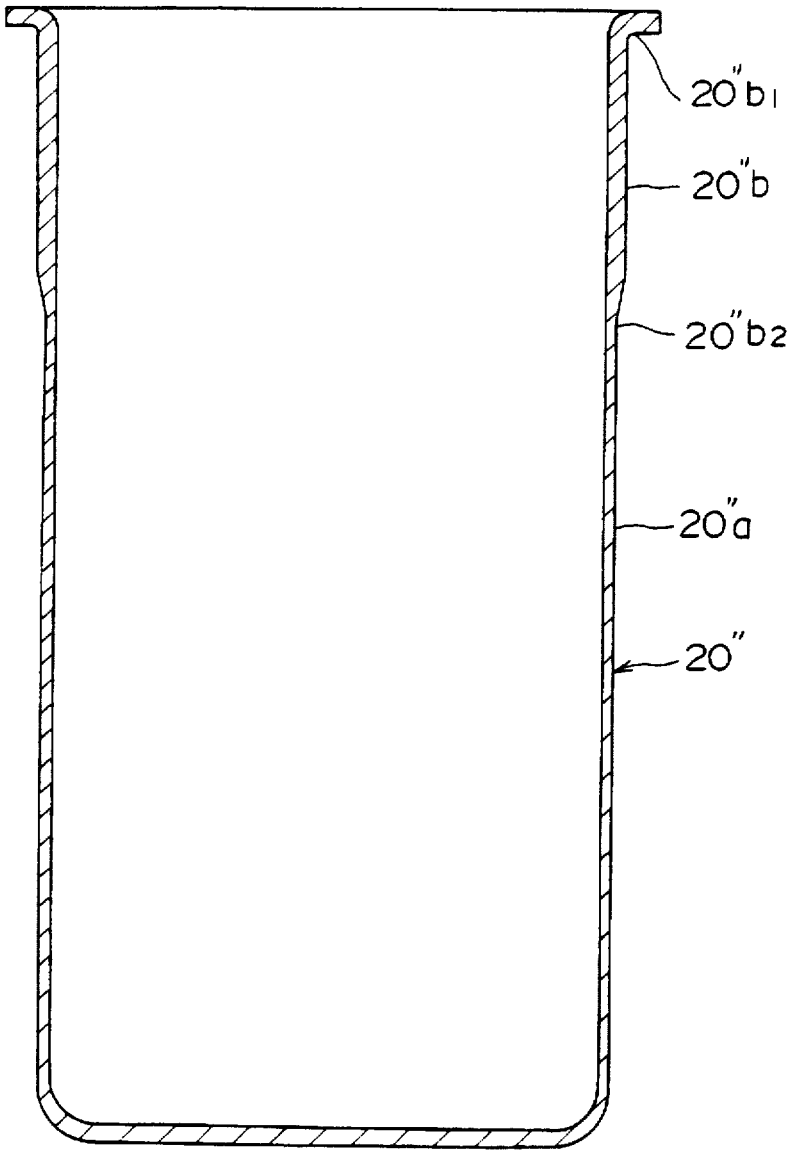
FIG. 16 is a vertical section view of the seamless can according to the second embodiment which is different from the seamless can 20 of FIG. 1.

According to the present invention, the ironing working is further executed in one stroke after the above-mentioned bend-elongation (thickness-reducing redraw working) and ironing working, making it possible to produce a seamless can 20" having an opening end 20"b that outwardly protrudes beyond the main barrel portion 20"a and is thickened as shown in FIG. 16.

Figure 14:
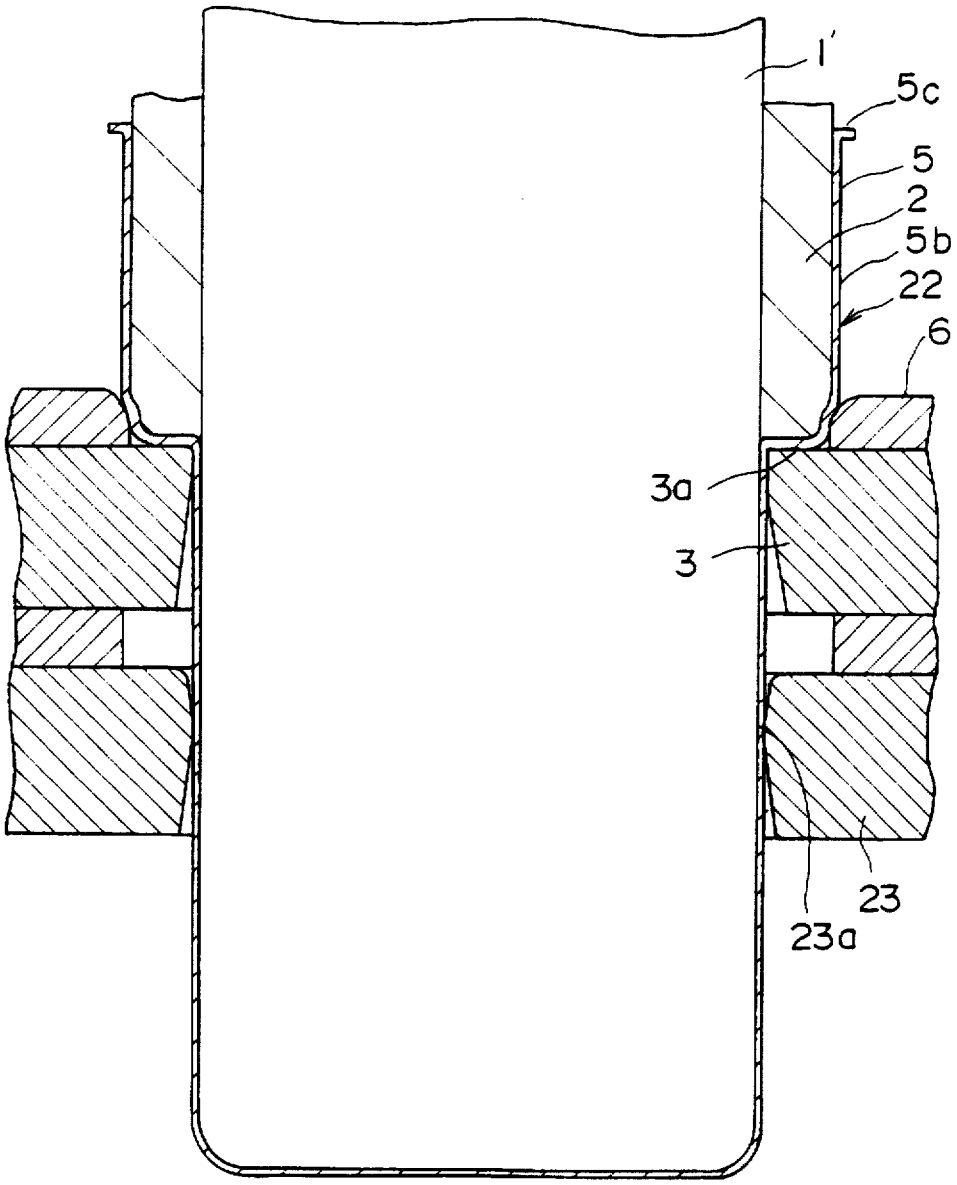
FIG. 14 is a vertical sectional view illustrating a state where a seamless can of a second embodiment different from the seamless can 20 of FIG. 1 is being formed.
Figure 15:
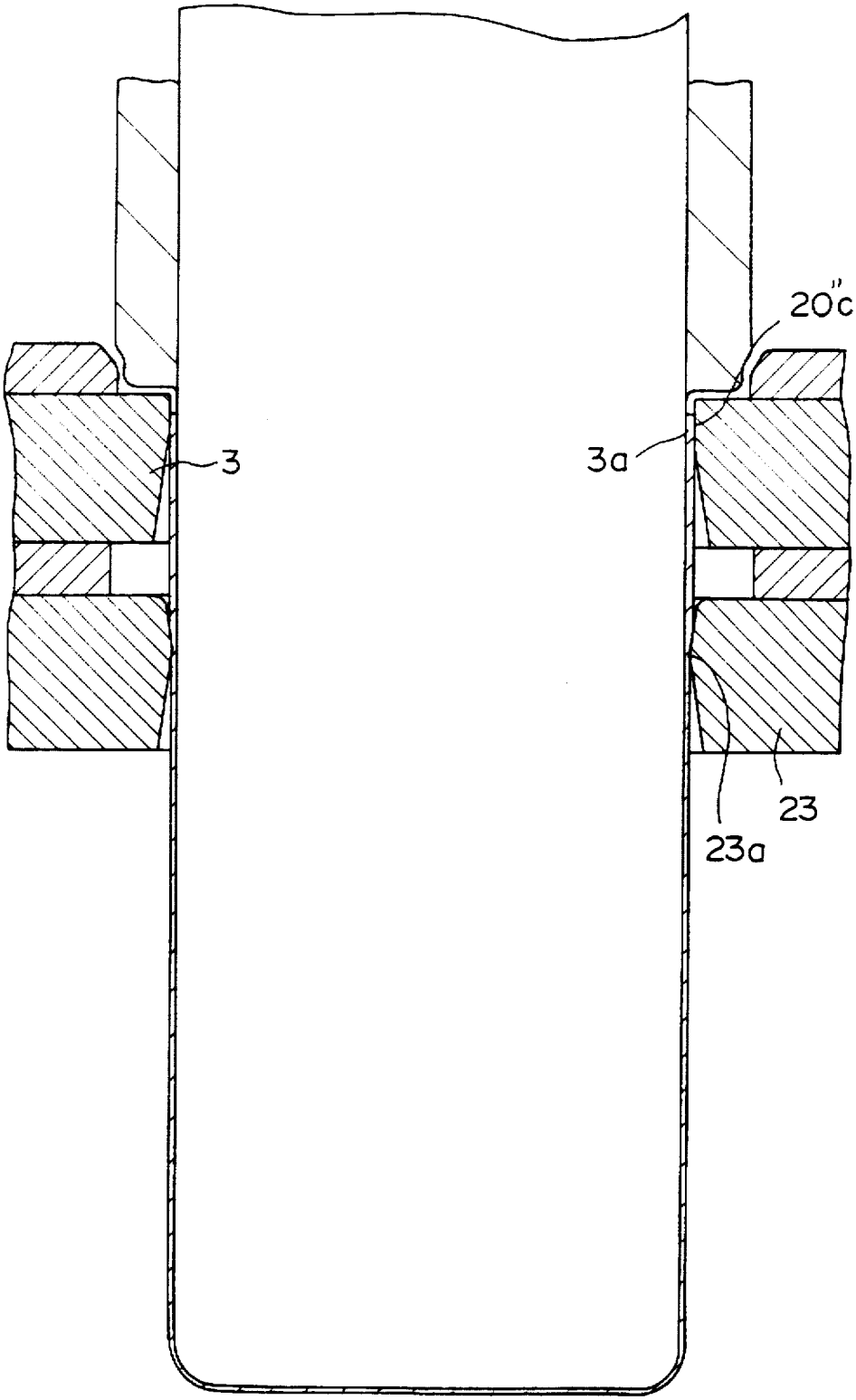
FIG. 15 is a vertical sectional view illustrating a state just after having finished the forming of the seamless can of the second embodiment which is different from the seamless can 20 of FIG. 1.

Furthermore, the seamless can may be formed in one stroke by the method shown in FIGS. 14 and 15.

FIG. 14 illustrates a state where the draw-formed metal cup 5 is being formed by using an ironing die 23 disposed near the front of the die 3 and a thickness-reducing redrawing/ironing tool 22 having the same blank holder 2, die 3 and annular bending member 6 as those shown in FIG. 3 which are controlled at the same temperatures as those of FIG. 3, except that a punch 1' has a uniform diameter over the whole length of the working portion (corresponds to the front portion la and to the diameter-contracted portion 1*b* of the punch 1 of FIG. 3), i.e., the punch 1' has a working portion of a cylindrical shape making a difference from the punch 1, the surface temperature Td of the ironing die 23 being controlled like that of the thickness-reducing redrawing/ironing tool 22. The distance between the flat surface portion 3*a* of the die 3 and the ironing portion 23*a* or the upper end thereof of the die 23 is equal to the length between the upper end 20"$b_1$ of thick portion of the opening end 20"b and the lower end of the tilted portion 20"$b_2$.

The thickness-reducing redrawing/ironing is executed by advancing the punch 1' of the tool 22 until the thickness of the side wall 5*b* of the draw-formed cup 5 is reduced by the die 3 to a predetermined value (thickness of the open end portion 20"b), and the ironing is executed by the die 23 until the flange portion 20"c (corresponds to the flange portion 5*c*) reaches the flat surface portion 3*a* of the die 3, so that the main barrel portion 20"a having a predetermined thickness is obtained.

The die 3 may be the one other than FIG. 3, e.g., may be those shown in FIGS. 7 to 11. Moreover, the ironing portion of the die 23 may be as shown in FIG. 13 to which only, however, the invention is in no way limited.

When the seamless can is used as a container for beverages in which the inner pressure will be applied, in general, the thickness (tw) of wall of can barrel is selected to be as small as possible to reduce the weight of the container, and the thickness (tf) of wall of necking portion (upper side of barrel portion) is so selected that the necking can be easily effected, i.e., tf>tw.

For instance, when the can-forming is effected by using a stepped punch 1 having a small-diameter portion 1*b* formed at an upper portion as shown in FIG. 3, a stepped portion is formed in the inner surface of the side wall to adjust the thickness. This method is called internal step method. As shown in FIG. 14, furthermore, when an annular die 3 having a large ironing diameter is arranged on the upper side and an annular die 23 having a small ironing diameter is arranged on the lower side, the thickness is adjusted by forming a step on the outer surface of the side wall. This method is called external step method.

The above methods have their merits and demerits. For instance, the internal step method is very advantageous from the standpoint of preventing breakage in the drum (breakage in the wall portion) just before the can-forming working is finished, since the upper part (necking part) of the can barrel which is subjected to severe working condition is formed at a low ironing ratio. In forming the barrel portion under the necking portion, however, the ironing working is effected at one time such that the wall thickness is reduced from $t_2$ to tw (which is smaller than tf), arousing a problem that the organic film 12 is scraped off during this stage. Moreover, since the inner diameter of the can that is formed becomes small toward the upper side, there remains inconvenience in regard to removing the punch 1.

According to the external step method, on the other hand, the ironing working for forming the can barrel under the necking portion is stepwisely effected, i.e., $t_2 \rightarrow tf \rightarrow tw$, giving advantage in that the organic film 12 is prevented from being scraped off. Moreover, there remains no problem in regard to removing the punch 1. However, since a step is formed on the outer surface of the can barrel, the appearance is not satisfactory. Even in ironing the upper part of the can barrel which is subjected to severe working condition to obtain the wall thickness tf, the ironing has been executed for the lower side to accomplish the smallest thickness tw, arousing a problem in that the barrel tends to be broken at the external step portion.

Figure 18:
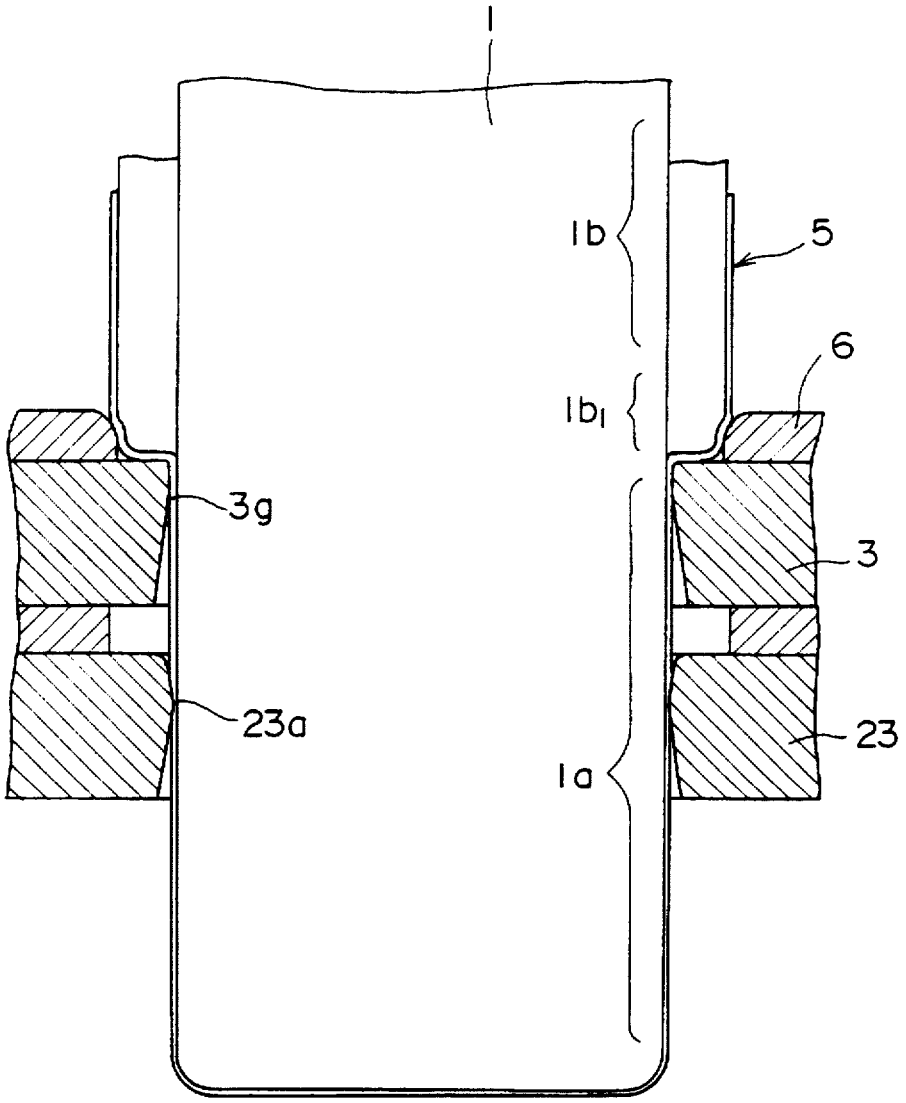
FIG. 18 is a diagram illustrating the working steps for producing seamless cans by the internal/external step method according to the present invention.
Figure 19:
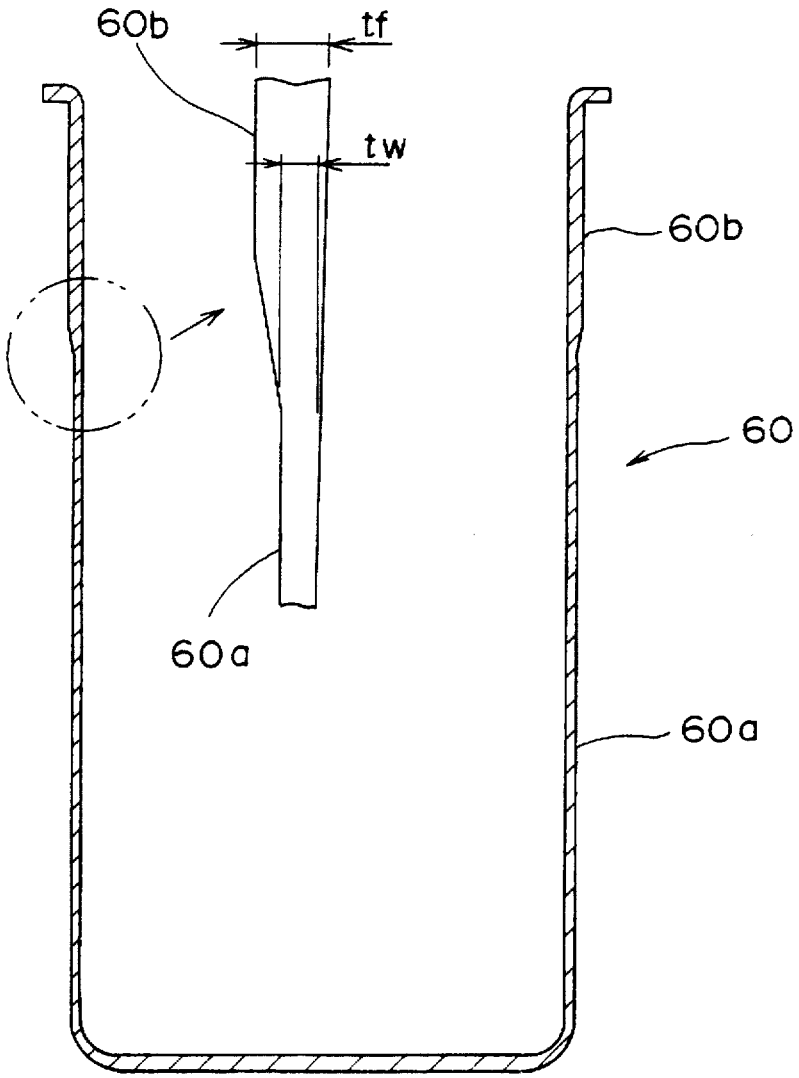
FIG. 19 is a diagram of a seamless can obtained by the method of FIG. 18.

According to the present invention, the abovementioned internal step method and the external step method are combined together to complement the defects of the two and to effectively utilize their merits. FIGS. 18 and 19 illustrate an embodiment of this method (hereinafter referred to as internal/external step method). That is, referring to FIG. 18 illustrating a can-forming step based on the internal/external step method, the punch 1 has a front portion (lower portion 1*a*) with a diameter corresponding to the inner diameter of the main barrel portion of the seamless can and a small diameter portion 1*b* corresponding to the inner diameter of a portion that will be subjected to the necking, like the one shown in FIG. 3, a tapered portion 1$b_1$ being formed therebetween. Like the one shown in FIG. 14, furthermore, the annular die has an upper annular die 3 and a lower annular die 23, the diameter of the ironing portion 3g formed in the working surface of the upper annular die 3 being larger than the diameter of the ironing portion 23a of the lower annular die 23. That is, the diameter of the ironing portion 3g corresponds to the outer diameter of the portion of the seamless can that will be subjected to the necking, and the diameter of the ironing portion 23a corresponds to the outer diameter of the main barrel portion. By using such a punch 1 and annular dies 3, 23, a seamless can 60 shown in FIG. 19 is obtained by advancing the punch 1 and executing the can- forming working like in the embodiment of FIG. 14.

As will be obvious from FIG. 19, the seamless can 60 has a main barrel portion 60a of a reduced thickness tw and a portion (thick portion) 60b of a thickness tf that will be subjected to the necking, forming steps on both the inner surface and the outer surface from the main barrel portion 60a to the thick portion 60b. The annular dies 3 and 23 are in no way limited to those shown in FIG. 18 but may be those having shapes shown in other drawings.

In forming the can based upon the internal/external step method, the main barrel portion 60a is ironed in two steps through the ironing portion 3g of the upper annular die 3 and the ironing portion 23a of the lower annular die 23, the thick portion 60b being ironed in one step by the ironing portion 3g at an ironing ratio of at least 5% and, preferably, from 10 to 40%. This ironing working is quite the same as the aforementioned ironing working of the embodiment of FIGS. 14 and 15. Moreover, balance and the like between the step formed on the inner surface and the step formed on the outer surface should be so set that the merits of the internal step method and of the external step method can be effectively utilized. Even in this method, the temperatures of the tools used for the forming are adjusted in the same manner as that of the one-stroke method that was described already.

[EXAMPLES]

(Experimental Example 1)

In the following experimental example, a seamless can was produced from a redraw-formed cup 5.

A paraffin wax (melting point MT: 60° C. ) was applied in an amount of about 50 mg/m$^2$ onto both surfaces of a laminated steel plate (total thickness of 0.230 mm) that was obtained by heat-adhering a biaxially drawn ethylene terephthalate/ethylene isophthalate copolymer (molar ratio: 88/12, melting point: 230° C. glass transition temperature Tg: 70° C. ) film 12 having a thickness of 0.020 mm onto both surfaces of a tin-free steel plate (electrolytic chromate-treated steel plate) having a thickness of 0.19 mm and a tempering degree of T-4 (Rockwell 30T hardness: 58 to 64).

The laminated steel plate was punched by using a draw-forming machine (not shown) into a circular blank 10 having a diameter of 165 mm. By using an ordinary die having a working corner of a radius of curvature Rd of 1.5 mm, the blank 10 was then draw-worked at a drawing ratio of 1.65 to obtain a pre-draw-formed cup 13 (FIG. 1) having an average height of 45 mm and an inner diameter of 100 mm.

By using a die having a working corner of a radius of curvature Rd of 0.34 mm ($Rd/t_0$=1.47), the pre-draw-formed cup 13 was subjected to the thickness-reducing redraw-working relying upon bend-elongation only at a drawing ratio of 1.23 in order to obtain a redraw-formed cup 5 having a height of 72 mm, an inner diameter of 81.3 mm and an average thickness of the side wall portion of 0.2 mm (average thickness-reducing ratio: 13%).

By using the apparatus of the type shown in FIG. 3, 7 or 4 (Test No. 8) and in FIG. 11 (Test Nos. 14 and 15), the redraw-formed cup 5 was subjected to the redraw-forming and ironing working (Test Nos. 1 to 9, 14 and 15) by setting the surface temperature Tp of the punch 1 immediately after removed at 60° C. but except for the Text Nos. 5 and 6 (the surface temperature Tp was 15° C. in the case of Text No. 5 and was 150° C. in the case of Test No. 6), and by changing the radius of curvature Rd of the working corner 3b of the die 3, approach angle α, gap width between the punch 1 and the ironing portion 3g, and surface temperature Td of the die 3. In the cases of Test Nos. 1 to 6, 9, 12 and 13, the die 3 possessed $Ri/t_0$ of 0.2. In the case of Test No. 7, the die 3 possessed $Ri/t_0$ of 10. In the cases of Test Nos. 14 and 15, the dies 3 possessed approach angles γ of the front approach surfaces 3c $_2$ of 2 degrees and 8 degrees, respectively.

For the purpose of comparison, the redraw-formed cup 5 was subjected to the thickness-reducing redraw-working by using the apparatus shown in FIG. 12 (Test Nos. 10, 11, Tp was 60° C.).

Furthermore, the draw-formed cup 5 was subjected to the thickness-reducing redraw-forming and ironing working relying upon the two-stroke method to obtain seamless cans 20 (Test Nos. 12 and 13).

In the cases, the punch 1 possessed a diameter in the front portion 1a of 66 mm, and the drawing ration was 1.24.

In Test No. 16, a seamless can 20 was prepared based on the internal/external step method shown in FIGS. 18 and 19. In this case, the punch 1 possessed a step of 0.01 mm, and a step between the two ironing portions was 0.009 mm.

Table 1 shows the working conditions and Table 2 shows the results of working. In Table 1, the "Drawing" and "Thickness-reducing ratio" are abbreviations of thickness-reduction increment. In the case of Test No. 4, the thickness-reducing rastion in the draw working is −3% which means that the thickness of the side wall 5b is increased by 3%. In Table 2, "Appearance good" stands for a state where the organic film 12 on the outer surface is smoothed by the ironing working, offering excellent printability.

TABLE 1

| Test | | Angle α | Gap width (mm) | | Td | Thickness-reducing | | | Final thickness- |
|---|---|---|---|---|---|---|---|---|---|
| | | | | | | | Ironing | | reducing |
| No. | $Rd/t_0$ | (deg.) | tf | tw | (°C.) | drawing | Tf | Tw | ratio (%) |
| 1 | 1.22 | 4 | 0.156 | 0.137 | 30 | 8 | 15 | 26 | 40 |
| 2 | 1.22 | 4 | 0.156 | 0.137 | 130 | 6 | 17 | 27 | 40 |

TABLE 1-continued

| Test No. | $Rd/t_0$ | Angle α (deg.) | Gap width (mm) tf | Gap width (mm) tw | Td (°C.) | Thickness-reducing drawing | Ironing Tf | Ironing Tw | Final thickness-reducing ratio (%) |
|---|---|---|---|---|---|---|---|---|---|
| 4 | 10.00 | 4 | 0.156 | 0.137 | 30 | −3 | — | (34) | — |
| 3 | 1.22 | 10 | 0.156 | 0.137 | 30 | 8 | — | (19) | — |
| 5 | 1.22 | 4 | 0.156 | 0.137 | 30 | (8) | (14) | (25) | — |
| 6 | 1.22 | 4 | 0.156 | 0.137 | 30 | 8 | 16 | 27 | 42 |
| 7 | 1.22 | 12 | 0.156 | 0.137 | 30 | 8 | 15 | 26 | 40 |
| 8 | 1.22 | — | 0.156 | 0.137 | 30 | 8 | 16 | 27 | 41 |
| 9 | 3.20 | 9 | 0.190 | 0.180 | 30 | 3 | 0.2 | 7.2 | 17 |
| 10 | 1.00 | — | — | — | 30 | 14 | — | — | 37 |
| 11 | 0.78 | — | — | — | 30 | — | — | — | — |
| 12 | 1.22 | 4 | 0.156 | 0.137 | 30 | 8 | 15 | 26 | 40 |
| 13 | 1.22 | 8 | 0.156 | 0.137 | 30 | 8 | 15 | 26 | 40 |
| 14 | 1.22 | 15 | 0.156 | 0.137 | 30 | 8 | 15 | 26 | 40 |
| 15 | 1.22 | 15 | 0.156 | 0.137 | 30 | 8 | (15) | (26) | — |
| 16 | 1.22 | 4 | 0.156 | 0.137 | 30 | 8 | 15 | 26 | 40 |

Test Nos. 1 to 9 and 12 to 15, the step of the punch is tf-tw and in Test No. 16, the step of punch plus step of ironing portion corresponds to tf-tw.

TABLE 2

| Test No. | Formability | Damage in organic film on the outer surface | Necking, flanging workability | Appearance |
|---|---|---|---|---|
| 1 | normal | normal | good | good |
| 2 | normal | outer surface scraped off | not evaluated | not evaluated |
| 3 | broken | not evaluated | not evaluated | not evaluated |
| 4 | broken | not evaluated | not evaluated | not evaluated |
| 5 | poorly removed | normal | not evaluated | not evaluated |
| 6 | normal | inner surface scraped off | not evalupated | good |
| 7 | normal | normal | good | good |
| 8 | normal | normal | good | good |
| 9 | can hight insufficient | outer surface scraped off | organic film whitened | poor |
| 10 | can hight insufficient | normal | organic film whitened | poor |
| 11 | broken | not evaluated | not evaluated | not evaluated |
| 12 | normal | normal | good | good |
| 13 | normal | outer surface scraped off | not evaluated | not evaluated |
| 14 | normal | normal | good | good |
| 15 | normal | outer surface scraped off | not evaluated | not evaluated |
| 16 | normal | normal | good | good |

Figure 17:
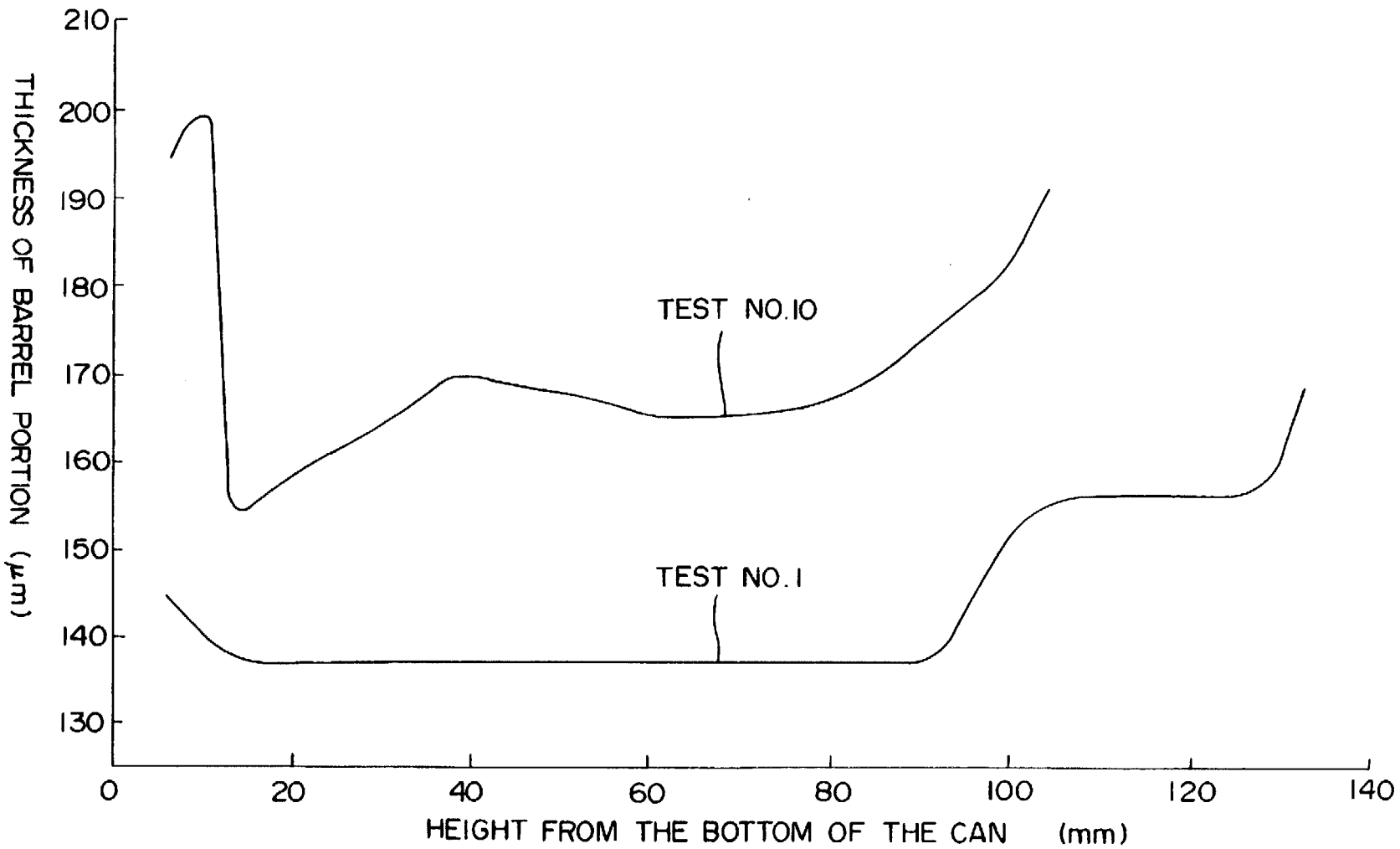
FIG. 17 is a diagram illustrating a relationship between the height from the bottom of the can and the thickness of the barrel portion using the seamless can produced by the method of the present invention and a seamless can of a comparative example.

In the case of Test No. 1 as shown in Tables 1 and 2, there were obtained a seamless can 20 and a container 21 having desired sizes of a height of 180 mm and an inner diameter of 66 mm, which were satisfactory. A curve of Test No. 1 of FIG. 17 represents a relationship between the thickness of the barrel portion of the seamless can 20 that was obtained and the height from the bottom of the can, from which it will be understood that the thickness is constant from a height of about 20 mm to a height of about 90 mm from the bottom of the can. The thickness slightly increases from a height of about 100 mm to a height of about 120 mm from the bottom of the can, since this portion corresponds to the diameter-contracted portion 1*b* of the punch 1, i.e., corresponds to the opening end portion 20*b*. The portion which is slightly thickened near the opening end portion is desirable since it does not develop cracking during the necking or flanging.

In the case of Test No. 2 in which the surface temperature Td of the die 3 was high, the formability was normal but the organic film 12 on the outer surface was scraped off and a satisfactory seamless can 20 was not obtained.

In the case of Test No. 3 in which the approach angle α was large, the barrel was broken and the seamless can 20 could not be obtained.

Even in the case of Test No. 4 in which $Rd/t_0$ was large, the thickness could not be reduced at the working corner 3*b* but, instead, the thickness slightly increased after the redraw-forming. Therefore, the thickness of the side wall portion 5*b* became far larger than the gap width 15 and a large force was required for the ironing working, resulting in the breakage of the barrel and making it difficult to obtain the seamless can 20.

In the case of Test No. 5 in which the Tp of the punch 1 was low, the can could be formed but the punch 1 could not be removed from the seamless can 20, and the subsequent forming operations could not be carried out.

In the case of Test No. 6 in which the Tp of the punch 1 was high, the organic film 12 on the inner surface was scraped off, and a satisfactory seamless can 20 could not be obtained.

In the case of Test No. 7, a satisfactory seamless can 20 and a satisfactory container 21 were obtained like in the case of Test No. 1.

Even in the case of test No. 8, a satisfactory seamless can 20 and a satisfactory container 21 could be obtained like in the case of Test No. 1.

In the case of Test No. 9 in which Rd was relatively high, approach angle α was relatively large, the gap width was slightly smaller than the average thickness of the side wall portion 5*b* , and the ironing ratio was very small, the thickness of the side wall portion 5*b* was not reduced to a sufficient degree, a desired height of the can was not obtained, the organic film 12 on the outer surface was scraped off, the organic film at the necked portion was whitened, the appearance was poor, and a satisfactory seamless can 20 and a container 21 could not be obtained.

In the case of Test No. 10 which was a conventional thickness-reducing redraw-forming method based only upon the redraw-forming but without effecting the ironing working. Rd/to was just at the verge of the lower limit of claim 4 but the thickness of the side wall portion 5b could not be reduced to a sufficient degree, and a predetermined height of can was not obtained. As represented by a curve of Test No. 10 in FIG. 17, furthermore, the thickness of the sheet varied to a large degree in the direction of height. Moreover, the organic film 12 at the necked portion was whitened, the appearance was poor, and a satisfactory seamless can 20 and a container 21 could not be obtained.

In the case of Test No. 11 which was a conventional method similar to that of the case of Test No. 10, $Rd/t_0$ was very small. Therefore, the barrel was broken, and a seamless can 20 could not be obtained.

In the case of Test No. 12 in which the testing conditions were the same as those of Test No. 1 except that the redraw-forming step and the ironing step were separately carried out in two strokes, there were obtained a satisfactory seamless can 20 and a satisfactory container 21.

In the case of Test No. 13 in which the testing conditions were the same as those of Test No. 12 except that the working was carried out in two strokes and the approach angle α was large, the formability was normal, but the organic film 12 on the outer surface was scraped off and a satisfactory seamless can 20 was not obtained.

In the case of Test No. 14, a satisfactory seamless can 20 and a container 21 were obtained like in the case of Test No. 1.

In the case of Test No. 15 in which the testing conditions were the same as those of Test No. 14 except that the approach angle γ of the front approach surface $3c_2$ was large, the formability was normal, but the organic film 12 on the outer surface was scraped off and a satisfactory seamless can 20 was not obtained.

(Experimental Example 2)

Concretely described below is an example in which a seamless can 20 was directly obtained from a pre-draw-formed cup 13 (FIG. 1).

A paraffin wax (melting point MT: 60° C ) was applied in an amount of about 50 $mg/m^2$ onto both surfaces of a laminated steel plate (total thickness of 0.230 mm) that was obtained by heat-adhering a biaxially drawn ethylene terephthalate/ethylene isophthalate copolymer (molar ratio: 88/12, melting point: 230° C., glass transition temperature Tg: 70° C. ) film 12 having a thickness of 0.020 mm onto both surfaces of a tin-free steel plate (electrolytic chromate-treated steel plate) having a thickness of 0.19 mm and a tempering degree of T-4 (Rockwell 30T hardness: 58 to 64). The laminated steel plate was punched by using a draw-forming machine (not shown) into a circular blank 10 having a diameter of 165 mm.

By using an ordinary die having a working corner of a radius of curvature Rd of 1.5 mm, the blank 10 was then draw-worked at a drawing ratio of 1.70 to obtain a pre-draw-formed cup 13 having an average height of 46.5 mm, an inner diameter of 97 mm and an average thickness in the side wall portion of 0.250 mm (average thickness-reducing ratio, −8%).

By using the apparatus of the type shown in FIGS. 3 and 7, the pre-draw-formed cup 13 was subjected to the redraw-forming and ironing working under the conditions of a drawing ratio of 1.47, radius of curvature at the working corner 3b of 0.34 mm ($Rd/t_0$=1.47), an angle α of 4 degrees, a gap width in the ironing surface 3e of 0.137 mm, and surface temperatures Td and Tp of the die 3 and punch 1 of 30° C. and 60° C. , respectively. The punch 1 was the one that was used in Experimental Example 1.

The thickness-reducing ratios through the drawing and ironing were 10% and 39%, and the final thickness-reducing ratio was 40%. In this case, there were obtained a satisfactory seamless can 20 and a satisfactory container 21 having desired sizes of a height of 130 mm and an inner diameter of 66 mm like in the case of Test No. 1 of Tables 1 and 2.

For the purpose of comparison, the redraw-forming and ironing working were carried out under the same conditions as those described above with the exception of selecting the radius of curvature at the working corner 3b to be 1.06 mm ($Rd/t_0$=4.60) and the surface temperature Td of the die 3 to be 130° C . However, the barrel was broken and the organic film 12 on the outer surface was scraped off, making it difficult to accomplish the forming.

The redraw-forming and ironing working were carried out under the same conditions as those of the above-mentioned Test No. 1 with the exception of using, as a metal sheet 11, an aluminum alloy sheet (A3004H19) having a thickness of 0.230 mm, selecting the radius of curvature Rd at the working corner 3b of the die 3 to be 0.397 mm ($Rd/t_0$=1.47), selecting the gap width to be 0.162 mm, setting the thickness-reducing ratio to be 5% and ironing ratio to be 23%. There were obtained a satisfactory seamless can 20 and a satisfactory container 21 having desired sizes of a height of 130 mm and an inner diameter of 66 mm.

We claim:

1. A method of producing a seamless can from a metal cup made of a metal sheet of which the inner and outer surfaces are coated with an organic film, which method comprises arranging coaxially (1) an annular die which has a horizontal surface, an annular working surface continuous to the horizontal surface, a working corner portion of a small radius of curvature at a boundary portion between said surfaces, an ironing portion that protrudes most toward an inner side and is formed in said annular working surface, and an approach surface connecting the working corner portion to the ironing portion having an approach angle α of from 1 to 5 degrees, wherein the radius of curvature Rd of said working comer is selected so that the ratio thereof to thickness $t_o$ of the coated metal blank ($Rd/t_o$) is from 1.0 to 2.9, and a junction portion between said approach surface and said ironing portion is a sharp corner portion or is a curvature portion having a radius of curvature Ri which is smaller than $0.3\times t_o$, (2) an annular blank holder, and (3) a punch having a front portion to form a main portion of side wall of the seamless can and a small diameter portion to form a thick portion to be subjected to necking of side wall of the seamless can, said annular die having a smaller inner diameter than an outer diameter of said annular blank holder; disposing said metal cup on said annular die; inserting said annular blank holder in the metal cup; advancing said punch from one annular blank holder into the annular die while pushing a bottom portion of the metal cup by the blank holder onto the horizontal surface of the annular die, so as to pass a wall portion of the metal cup that is to be worked through a space between the horizontal surface of the annular die and the blank holder and further through a space between the punch and the annular die; wherein a thickness of the side wall is reduced by bend-elongation at a working corner of the annular die so as to have a thickness (t2), and then a main portion of the side wall is reduced by ironing between the front portion of the punch and the ironing portion of the annular die at an ironing ratio of from 10 to 40%, and a thick portion to be subjected to necking of the side wall is reduced by ironing between the small diameter portion of the punch and the ironing portion of the annular die at an ironing ratio of at least 5%, while the wall portion after bend-elongation contacts the approach surface, said ironing being defined by the following formula:

$$\text{Ironing ratio} = \frac{t2 - t3}{t2} \times 100$$

where t2 is a thickness of the wall portion bend-elongated by the working corner, and t3 is a clearance between the ironing portion of the annular die and the punch.

2. A method of producing a seamless can according to claim 1, wherein said ironing portion has a width in the axial direction from an end portion of the approach surface as viewed on a side sectional view of the annular die.

3. A method of producing a seamless can according to claim 1, wherein the surface temperature Td of the annular die in contact with the wall of the material being worked, the surface temperature Ts of the blank holder of a portion facing the horizontal surface of the annular die, and the surface temperature Tp of the punch just after removed from the seamless can after the forming operation has been finished, are set to be not higher than a glass transition temperature of the organic film Tg+50° C. but is not lower than 10° C.

4. A method of producing a seamless can according to claim 1, wherein in said annular working surface is formed an escape surface in a direction opposite to the working corner from the ironing portion and in a direction to separate away from the punch that passes through the annular die, the escape angle β subtended by said escape surface and by the axis of the annular die being not larger than 5 degrees.

5. A method of producing a seamless can according to claim 1, wherein said approach surface comprises a rear approach surface on the side of the working corner and a front approach surface on the side opposite to the working corner, the approach angle α subtended by the rear approach surface and by the axis of the annular die is set to be from 1 to 5 degrees, the approach angle γ subtended by the front approach surface and by the axis of the annular die is from 1 to 5 degrees which is smaller than said approach angle α.

6. A method of producing a seamless can according to claim 5, wherein the junction portion between the rear approach surface and the front approach surface, and the junction portion between the front approach surface and the ironing portion, are sharp corner portions or are curvature portions having a radius of curvature Ri which is smaller than $0.3 \times t_0$.

* * * * *